US008997281B2

(12) United States Patent
Daley et al.

(10) Patent No.: US 8,997,281 B2
(45) Date of Patent: Apr. 7, 2015

(54) OPERATING TABLE TOP ASSEMBLIES AND RELATED DEVICES

(75) Inventors: Edward Daley, Mount Pleasant, SC (US); Patrick Schleitzer, Unterwellenborn (DE); Ivo Mueller, Saalfeld (DE); Rene Harig, Dresden (DE); Rene Lenk, Kroelpa (DE); Peter Schumann, Marienberg (DE); Heinz-Hermann Dalbert, Charleston, SC (US)

(73) Assignee: Trumpf Medizin Systeme GmbH + Co. KG, Saalfeld (DE)

( * ) Notice: Subject to any disclaimer, the term of this patent is extended or adjusted under 35 U.S.C. 154(b) by 277 days.

(21) Appl. No.: 13/428,795

(22) Filed: Mar. 23, 2012

(65) Prior Publication Data

US 2013/0247301 A1 Sep. 26, 2013

(51) Int. Cl.

| | |
|---|---|
| ***A61G 7/015*** | (2006.01) |
| ***A61G 13/10*** | (2006.01) |
| ***A61G 13/12*** | (2006.01) |

(52) U.S. Cl.

CPC ..... *A61G 13/129* (2013.01); *A61G 13/101* (2013.01)

(58) Field of Classification Search

USPC ..... 5/613, 601, 610–611, 616, 618, 600

See application file for complete search history.

(56) References Cited

U.S. PATENT DOCUMENTS

| | | | | |
|---|---|---|---|---|
| 5,628,080 | A | 5/1997 | Quintile | |
| 6,470,520 | B1 | 10/2002 | Weismiller et al. | |
| 7,412,311 | B2 | 8/2008 | Georgi et al. | |
| D604,422 | S | 11/2009 | Albrecht et al. | |
| 7,761,939 | B2 | 7/2010 | Wiggins et al. | |
| 7,784,126 | B2 | 8/2010 | Meissner et al. | |
| 2004/0148703 | A1 | 8/2004 | Doering et al. | |
| 2004/0200001 | A1 | 10/2004 | Stolze et al. | |
| 2004/0216233 | A1 | 11/2004 | Ludwig et al. | |
| 2006/0103226 | A1 | 5/2006 | Wong et al. | |
| 2007/0107122 | A1 | 5/2007 | Georgi et al. | |
| 2007/0107129 | A1 * | 5/2007 | Burstner et al. | 5/618 |
| 2008/0034502 | A1 | 2/2008 | Copeland et al. | |
| 2008/0289113 | A1 | 11/2008 | Berrocal et al. | |
| 2010/0011504 | A1 | 1/2010 | Hegarat et al. | |
| 2010/0293719 | A1 | 11/2010 | Klemm et al. | |

(Continued)

FOREIGN PATENT DOCUMENTS

| | | | |
|---|---|---|---|
| DE | 202011000308 | U1 | 5/2011 |
| EP | 1295583 | A2 | 3/2003 |
| WO | WO2006034914 | A1 | 4/2006 |

OTHER PUBLICATIONS

"Engineering Properties of Electroless Nickel Coatings", May 19, 1983, retrieved from the Internet: http://www.techmetals.com/InternetArticles/Engineering%20Properties%20of%20EN%20Coatings.pdf.

(Continued)

*Primary Examiner* — Fredrick Conley

(74) *Attorney, Agent, or Firm* — Fish & Richardson P.C.

(57) ABSTRACT

This disclosure relates to operating table top assemblies and related devices. In some aspects, an operating table top coupling assembly includes a receiver assembly and a hook assembly. The receiver assembly includes first and second spaced walls that define a central recess therebetween. The hook assembly includes an elongate hook member attached to or integrally formed with a housing that is configured to be at least partially disposed within the central recess of the receiver assembly.

17 Claims, 20 Drawing Sheets

(56) References Cited

U.S. PATENT DOCUMENTS

2012/0204885 A1 8/2012 Koch
2013/0247299 A1 9/2013 Schleitzer et al.

OTHER PUBLICATIONS

"Polytechnisch Zakboek, Passingen", Jan. 1, 2002, Elsevier, Arnhem, XP002712683.

Notification of Transmittal of the International Search Report and the Written Opinion of the International Searching Authority for corresponding PCT Application No. PCT/IB2013/000972, mailed Oct. 14, 2013, 53 pages.

International Search Rerport from corresponding PCT Application No. PCT/IB2013/000972, mailed Oct. 14, 2013, 3 pages.

* cited by examiner

OPERATING TABLE TOP ASSEMBLIES AND RELATED DEVICES

TECHNICAL FIELD

This disclosure relates to operating table top assemblies and related devices.

BACKGROUND

Operating tables are used to support patients during surgical procedures. Some operating tables are modular systems that include multiple different table top components that can be releasably coupled to one another. The components can be coupled together in a manner to provide an operating table top configuration that meets the demands of a particular surgical procedure to be performed.

SUMMARY

In one aspect of the invention, an operating table top assembly includes a first table top component, a receiver assembly attached to or integrally formed with the first table top component, a second table top component, and a hook assembly attached to or integrally formed with the second table top component. The receiver assembly includes first and second spaced walls that define a central recess therebetween. The first wall has an outer side surface and a projection that extends laterally from the outer side surface. The projection defines an undercut. The hook assembly includes an elongate hook member attached to or integrally formed with a housing. The hook member has a tip portion. The housing is configured to be at least partially disposed within the central recess of the receiver assembly, and the tip portion of the hook member is configured to matingly engage the undercut defined by the projection of the receiver assembly. The housing of the hook assembly is at least partially disposed within the central recess of the receiver assembly when the first table top component is coupled to the second table top component, and the tip portion of the hook member of the hook assembly matingly engages the undercut defined by the projection of the receiver assembly when the first table top component is coupled to the second table top component.

In another aspect of the invention, an operating table includes a central column and an operating table top assembly that includes a first table top component mounted on the central column, a receiver assembly attached to or integrally formed with the first table top component, a second table top component that can be coupled to the first table top component, and a hook assembly attached to or integrally formed with the second table top component. The receiver assembly includes first and second spaced walls that define a central recess therebetween. The first wall has an outer side surface and a projection that extends laterally from the outer side surface. The projection defines an undercut. The hook assembly includes an elongate hook member attached to or integrally formed with a housing. The hook member has a tip portion. The housing is configured to be at least partially disposed within the central recess of the receiver assembly, and the tip portion of the hook member is configured to matingly engage the undercut defined by the projection of the receiver assembly. The housing of the hook assembly is at least partially disposed within the central recess of the receiver assembly when the first table top component is coupled to the second table top component, and the tip portion of the hook member of the hook assembly matingly engages the undercut defined by the projection of the receiver assembly when the first table top component is coupled to the second table top component.

In an additional aspect of the invention, an operating table top coupling device includes a receiver assembly including first and second spaced walls that define a central recess therebetween. The first wall has an outer side surface and a projection that extends laterally from the outer side surface. The projection defines an undercut. The operating table coupling device also includes a hook assembly including an elongate hook member attached to or integrally formed with a housing. The hook member has a tip portion. The housing is configured to be at least partially disposed within the central recess of the receiver assembly, and the tip portion of the hook member is configured to matingly engage the undercut defined by the projection of the receiver assembly.

In a further aspect of the invention, an operating table top coupling device includes a receiver assembly including first and second spaced walls that define a central recess therebetween. The first wall has an outer side surface and a projection that extends laterally from the outer side surface. The projection defines an undercut. The central recess is configured to receive at least a portion of a housing of a hook assembly when the hook assembly is coupled to the receiver assembly, and the undercut is configured to matingly engage a tip portion of a hook member of the hook assembly when the hook assembly is coupled to the receiver assembly.

In an additional aspect of the invention, an operating table top coupling device includes a hook assembly including an elongate hook member attached to or integrally formed with a housing. The hook member has a tip portion. The housing is configured to be at least partially disposed within a central recess of a receiver assembly when the hook assembly is coupled to the receiver assembly, and the tip portion of the hook member is configured to matingly engage an undercut defined by a projection of the receiver assembly when the hook assembly is coupled to the receiver assembly.

In another aspect of the invention, an operating table top assembly includes a first table top component, a first coupling member attached to or integrally formed with the first table top component, a second table top component, and a second coupling member attached to or integrally formed with the second table top component. The first coupling member includes first and second spaced walls that define a central recess therebetween. One of the first and second walls defines an aperture. The second coupling member is configured to matingly engage the first coupling member in a manner to couple the first table top component to the second table top component. The second coupling member includes a housing configured to be at least partially disposed within the central recess of the first coupling member, a spring-loaded member that can be moved between an extended position in which the spring-loaded member extends from a side surface of the housing and a retracted position in which the spring-loaded member is retracted into the housing, an actuator that is operably connected to the spring loaded member in a manner such that movement of the actuator can move the spring-loaded member from the extended position to the retracted position, and a locking mechanism configured to retain the spring-loaded member in the retracted position when the housing of the second coupling member is matingly engaged with the first coupling member such that the housing of the second coupling member is at least partially disposed within the central recess of the first coupling member.

In a further aspect of the invention, an operating table includes a central column and an operating table top assembly including a first table top component mounted on the central column, a first coupling member attached to or integrally formed with the first table top component, a second table top component, and a second coupling member attached to or integrally formed with the second table top component. The first coupling member includes first and second spaced walls that define a central recess therebetween. One of the first and second walls defines an aperture. The second coupling member is configured to matingly engage the first coupling member in a manner to couple the first table top component to the second table top component. The second coupling member includes a housing configured to be at least partially disposed within the central recess of the first coupling member, a spring-loaded member that can be moved between an extended position in which the spring-loaded member extends from a side surface of the housing and a retracted position in which the spring-loaded member is retracted into the housing, an actuator that is operably connected to the spring loaded member in a manner such that movement of the actuator can move the spring-loaded member from the extended position to the retracted position, and a locking mechanism configured to retain the spring-loaded member in the retracted position when the housing of the second coupling member is matingly engaged with the first coupling member such that the housing of the second coupling member is at least partially disposed within the central recess of the first coupling member.

In yet another aspect of the invention, an operating table top coupling device includes a housing, an elongate hook member attached to or integrally formed with the housing, a spring-loaded member that can be moved between an extended position in which the spring-loaded member extends from a side surface of the housing and a retracted position in which the spring-loaded member is retracted into the housing, an actuator that is operably connected to the spring loaded member in a manner such that movement of the actuator can move the spring-loaded member from the extended position to the retracted position, and a locking mechanism configured to retain the spring-loaded member in the retracted position when the operating table top coupling member is matingly engaged with an associated operating table top coupling member.

Embodiments can include one or more of the following features.

In some embodiments, the first wall is positioned outwardly of the second wall relative to the first table top component, and the hook assembly is configured such that the hook member extends along the outer side surface of the first wall of the receiver assembly when the first table top component is coupled to the second table top component.

In certain embodiments, the hook member of the hook assembly and the lateral projection of the receiver assembly are visible along a side surface of the operating table top such that a user can visually determine whether the tip portion of the hook member is matingly engaged with the undercut defined by the projection of the receiver assembly.

In some embodiments, a width of the central recess of the receiver assembly is no more than about 1.5 mm greater than a width of the housing of the hook assembly.

In certain embodiments, a gap is formed between a portion of the housing and the hook member of the hook assembly, and the gap is configured to receive a portion of the second wall of the receiver assembly when the first table top component is coupled to the second table top component.

In some embodiments, the hook member is attached to or integrally formed with a side wall extension of the housing, and the gap is adjacent the side wall extension.

In certain embodiments, a width of the gap is no more than about 1.0 mm greater than a width of the portion of the second wall of the receiver assembly.

In some embodiments, the hook assembly further includes a spring-loaded member that can be moved between an extended position in which the spring-loaded member extends from a side surface of the housing and a retracted position in which the spring-loaded member is retracted into the housing, and one of the first and second walls of the receiver assembly defines an aperture configured to receive a portion of the spring-loaded member when the spring-loaded member is in the extended position.

In certain embodiments, the spring-loaded member is completely retracted into the housing when the spring-loaded member is in the retracted position.

In some embodiments, the second wall of the receiver assembly defines the aperture.

In certain embodiments, the second wall is positioned inwardly of the first wall relative to the first table top component.

In some embodiments, the spring loaded-member is a spring-loaded pin.

In certain embodiments, the hook assembly further includes an actuator assembly having an actuator that is operably connected to the spring loaded member in a manner such that movement of the actuator can move the spring-loaded member from the extended position to the retracted position.

In some embodiments, the hook assembly further includes a locking mechanism that retains the spring-loaded member in the retracted position while the housing of the hook assembly is at least partially disposed within the central recess of the receiver assembly.

In certain embodiments, the locking mechanism includes a ball spring that engages a surface of the spring-loaded member while the housing of the hook assembly is at least partially disposed within the central recess of the receiver assembly and the spring-loaded member is retracted.

In some embodiments, the ball spring engages a surface of a tab extending from the spring-loaded member.

In certain embodiments, the ball spring engages a depression formed in a surface of the spring-loaded member.

In some embodiments, the ball spring protrudes from a bottom surface of the housing and contacts an upper surface of a third wall extending between the first and second walls of the receiver assembly while the housing of the hook assembly is at least partially disposed within the central recess of the receiver assembly.

In certain embodiments, the one of the first and second walls of the receiver assembly that defines the aperture configured to receive the portion of the spring-loaded member has a ramp portion arranged to depress the spring-loaded member as the housing of the hook assembly is slid into the central recess of the receiver assembly.

In some embodiments, the receiver assembly further includes a third wall that extends between the first and second walls and that defines an opening configured to receive a boss extending from the housing.

In certain embodiments, the opening is configured to receive only bosses of hook assemblies attached to or integrally formed with second table top components that are intended for use with the first table top component to which the receiver assembly is attached.

In some embodiments, the tip portion of the hook member is located at a first end region of the hook member, and the hook member includes a lobe extending from a central region of the hook member. The projection of the receiver assembly further defines a depression configured to receive the lobe when the first table top component is coupled to the second table top component.

In certain embodiments, the receiver assembly is attached to or integrally formed with a first side region of the first table top component and the hook assembly is attached to or integrally formed with a first side region of the second table top component.

In some embodiments, the operating table top assembly further includes a second receiver assembly attached to or integrally formed with a second side region of the first table top component and a second hook assembly attached a second side region of the second table top component. The second hook assembly is configured to releasably engage the second receiver assembly when the first table top component is coupled to the second table top component.

In certain embodiments, the receiver assembly is attached to or integrally formed with a first end region of the first table top component.

In some embodiments, the operating table top assembly further includes a second receiver assembly attached to or integrally formed with a second end region of the first table top component. The first end region is opposite the second end region.

In certain embodiments, the second receiver assembly is configured to releasably engage a hook assembly attached to or integrally formed with a third table top component when the third table top component is coupled to the first table top component.

In some embodiments, the hook assembly is attached to or integrally formed with a first end region of the second table top component, and a receiver assembly is attached to or integrally formed with a second end region of the second table top component. The first end region is opposite the first end region.

In certain embodiments, the receiver assembly attached to or integrally formed with the second end region of the second table top component is configured to releasably engage a hook assembly attached to or integrally formed with a third table top component when the third table top component is coupled to the second table top component.

In some embodiments, the first table top component is configured to mount on a column of an operating table.

In certain embodiments, the second table top component is mounted to a first end region of the first table top component and a third table top component is mounted to a second end region of the first table top component. The first end region is opposite the second end region.

In some embodiments, the first table top component is a seat and back component, the second table top component is a head component, and the second table top component is a leg component.

In certain embodiments, the locking mechanism includes a ball spring that engages a surface of the spring-loaded member while the housing of the second coupling member is at least partially disposed within the central recess of the first coupling member and the spring-loaded member is retracted.

In some embodiments, the ball spring engages a surface of a tab extending from the spring-loaded member.

In certain embodiments, the ball spring engages a depression formed in a surface of the spring-loaded member.

In some embodiments, the ball spring protrudes from a bottom surface of the housing and is arranged to contact a wall of the associated operating table top coupling member when the operating table top coupling member is matingly engaged with the associated operating table top coupling member.

In certain embodiments, the spring-loaded member is completely retracted into the housing when the spring-loaded member is in the retracted position.

In some embodiments, the spring loaded-member is a spring-loaded pin.

In certain embodiments, the operating table top coupling device further includes a receiver assembly having a side wall forming an aperture configured to receive a portion of the spring-loaded member when the hook assembly is coupled to the receiver assembly and the spring-loaded member is in the extended position.

Embodiments can include one or more of the following advantages.

In some embodiments, the hook member of the hook assembly is positioned outwardly of the outer side surface of the receiver assembly when the hook assembly and receiver assembly are engaged. This can provide the surgeon and surgical staff with clear visualization of the mated features of the hook and the projection extending from the outer wall of the receiver assembly. As a result, the surgeon and surgical staff can readily determine visually whether the hook assembly and receiver assembly are properly engaged.

In certain embodiments, the hook member extends forwardly beyond the front edge of the table top component to which the hook assembly is attached and the receiver assembly extends rearwardly beyond the rear edge of the component to which the receiver assembly is attached. As a result of this arrangement, the surgeon or surgical staff member can clearly see the initial contact between the hook member and the receiver assembly when he or she couples the first and second table top components to one another. This can help the surgeon or surgical staff member to ensure that the hook member is properly aligned with the receiver assembly during the initial phases of the coupling process.

In some embodiments, the lateral projection of the receiver assembly forms a ramp along which the hook member slides when the hook assembly is being coupled to the receiver assembly. In this way, the lateral projection of the receiver assembly can carry some of the weight of the table top component to which the hook assembly is attached as that table top component is being coupled to the table top component to which the receiver assembly is attached. This can make it easier for the surgeon or surgical staff member to couple the table top components to one another.

In certain embodiments, the hook assembly includes a spring-loaded member that can be configured in an extended position in which it engages an aperture in a wall of the receiver assembly in order to secure the hook assembly to the receiver assembly and can be configured in a retracted position in which it does not engage the aperture of the wall of the receiver assembly. The hook assembly can further include a locking mechanism that automatically holds the spring-loaded member in the retracted position when the hook assembly is coupled with the receiver assembly. Locking the spring-loaded member in this way allows the surgeon or surgical staff to decouple the hook assembly from the receiver assembly without having to apply a constant force to hold the spring-loaded member in the retracted position.

In some embodiments, the locking mechanism is configured so that once the hook assembly has been removed from the receiver assembly, the locking mechanism will automatically release the spring-loaded member allowing the spring-loaded member to return to its naturally biased extended position. As a result, the hook assembly will be ready for reattachment to the receiver assembly or to a different receiver assembly without the need for the surgeon or surgical staff member to reset the spring-loaded member to its extended position.

In some embodiments, the wall of the receiver assembly that contacts the spring-loaded button of the hook assembly during engagement of those assemblies includes a ramped segment that depresses the spring-loaded button into its retracted position. As a result, there is no need for the surgeon or surgical staff member to manually or otherwise retract the spring-loaded member prior to mating the hook assembly with the receiver assembly. This can reduce the time and effort required to couple the hook assembly to the receiver assembly.

In certain embodiments, the wall of the receiver assembly that includes the aperture in which the spring-loaded member is received is spaced inwardly from a side edge of the operating table. For example, the receiver assembly can include an outer wall and an inner wall that is inwardly spaced from the outer wall and the side of the operating table and that defines the aperture. Spacing the aperture inwardly from the side of the operating table in this way results in the aperture and the spring-loaded member protruding therefrom being positioned below the operating table. Due to this positioning, the likelihood of the aperture and spring-loaded member being exposed to body fluids and other surgical byproducts that might obstruct the aperture and negatively affect the operability of the spring-loaded member can be reduced. As a result, the reliability and life spans of the receiver assembly and the hook assembly may be increased.

In some embodiments, the spring-loaded member of the hook assembly engages the aperture of the wall of the receiver assembly when the hook assembly is coupled to the receiver assembly. This provides a mechanical connection that helps to secure the hook assembly to the receiver assembly. In addition, the tip portion of the hook member matingly engages the undercut of the projection of the receiver assembly when the hook assembly is coupled to the receiver assembly. This also provides a mechanical connection that helps to secure the hook assembly to the receiver assembly. The engagement between the tip portion of the hook member and the undercut of the projection will advantageously provide a secure connection between the hook assembly and the receiver assembly in the event that the spring-loaded member fails to properly engage the aperture. Further, the mechanical engagement resulting from both the engagement between the spring-loaded member and the aperture and the engagement between the tip portion of the hook member and the undercut of its associated projection can occur automatically as part of the coupling process. There is typically no need for the surgeon or surgical staff member to perform an additional locking step, such as tightening a knob, in order to properly secure the hook assembly to the receiver assembly.

In certain embodiments, the operating table top assemblies include various different table top components that can be configured in different ways to provide different table top configurations. In such embodiments, the hook assemblies and receiver assemblies of those table top components can use a mechanical coding system to prevent table top components from being connected to other table top components that are not designed to support the loads that would result from that configuration. The coding system can advantageously be provided by the interaction between a boss extending from the housing of the hook assembly and an opening formed in a transverse wall of the receiver assembly. In such cases, the table top components that are capable of bearing large loads include receiver assemblies with large windows, while the table top components that are capable of bearing only small loads include receiver assembly with smaller windows. Similarly, the table top components that are heavy or will produce large loads during use are equipped with hook assemblies that include large bosses, while the table top components that are light or will produce small loads during use are equipped with hook assemblies that include smaller bosses. In this way, the table top components that are light or that will produce small loads during use can be coupled to table top components that are capable of bearing small loads and table top components that are capable of bearing large loads. In contrast, the heavy table top components cannot be coupled to table top components that are only capable of bearing small loads because the boss of the heavy table top component will be too large to fit within the window of the table top component that can only bear small loads. This type of coding system provides an easy way to alert the user that an improper combination of table top components has been selected for use by preventing the corresponding hook assemblies and receiver assemblies of those components from fully engaging during the coupling process.

The details of one or more embodiments of the invention are set forth in the accompanying drawings and the description below. Other aspects, features, and advantages of the invention will be apparent from the description and drawings, and from the claims.

DETAILED DESCRIPTION

Figure 1:
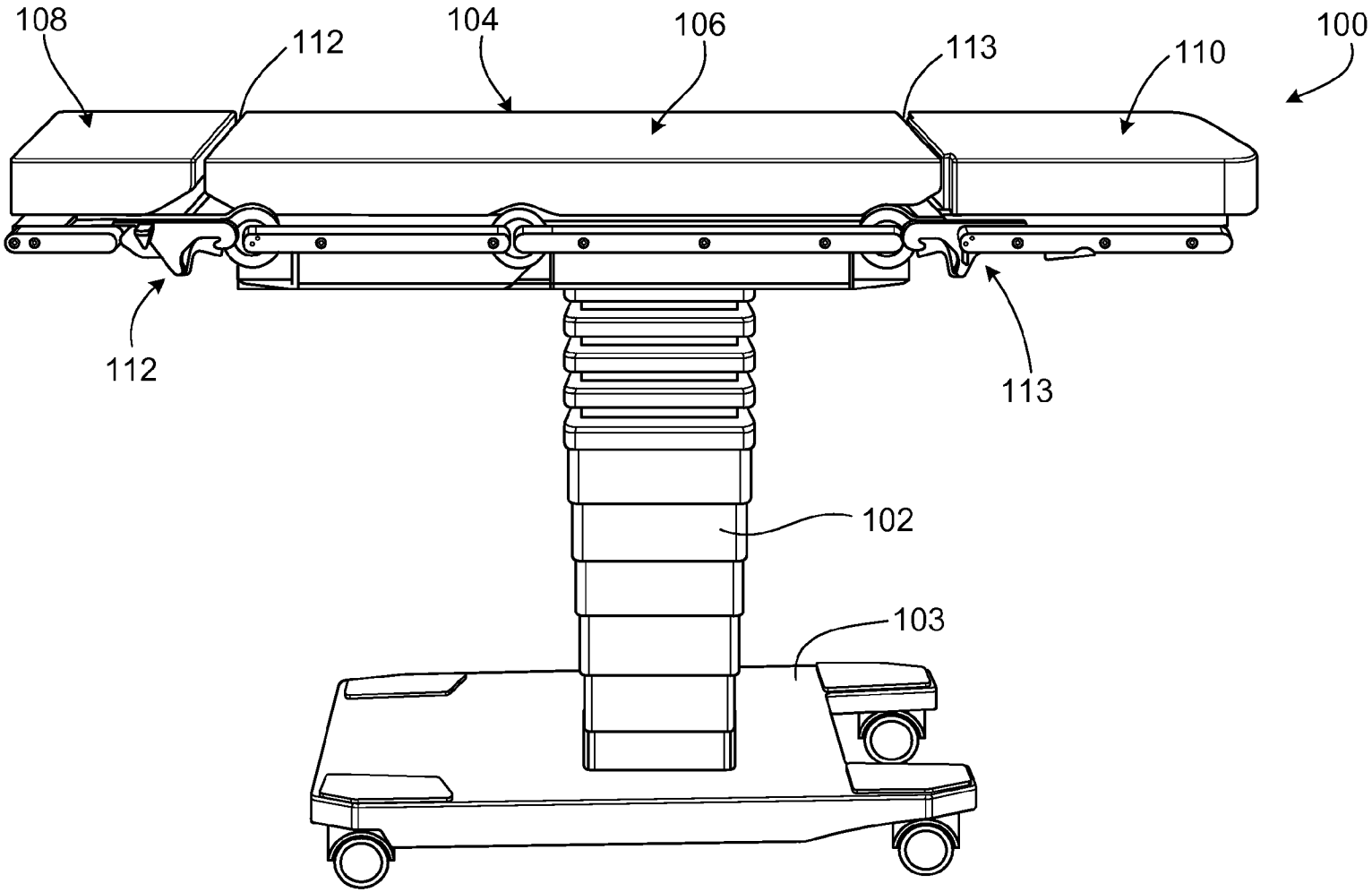
FIG. 1 is a perspective view of an operating table that includes a table top assembly formed of multiple table top components that are coupled together by coupling devices.

As shown in FIG. 1, an operating table 100 includes a support column 102 that extends from a base 103. A table top assembly 104 is mounted on the support column 102. The table top assembly 104 includes a hinged seat and back component 106 mounted on the support column 102. A head component 108 extends from the top end of the seat and back component 106, and a leg component 110 extends from the bottom end of the seat and back component 106. The table top components 106, 108, 110 each include a pad positioned atop a support board that is secured to a frame. The head component 108 is releasably coupled to the top end of the seat and back component 106 by right and left coupling devices 112. Similarly, the leg component 110 is releasably coupled to the bottom end of the seat and back component 106 by right and left coupling devices 113. Matingly engaging features of the coupling devices 112, 113 are visible along the sides of the operating table 100 to allow a surgeon or surgical staff member to determine at a glance whether the various table top components are properly coupled together.

The left coupling device 112, which couples the left side of the head component 108 to the seat and back component 106, is a mirror image of the associated right coupling device 112. Similarly, the left coupling device 113, which couples the left side of the leg component 110 to the seat and back component 106, is a mirror image of the associated right coupling device 113. Therefore, the right and left coupling devices 112, 113 will not be separately described in detail.

Figure 2:
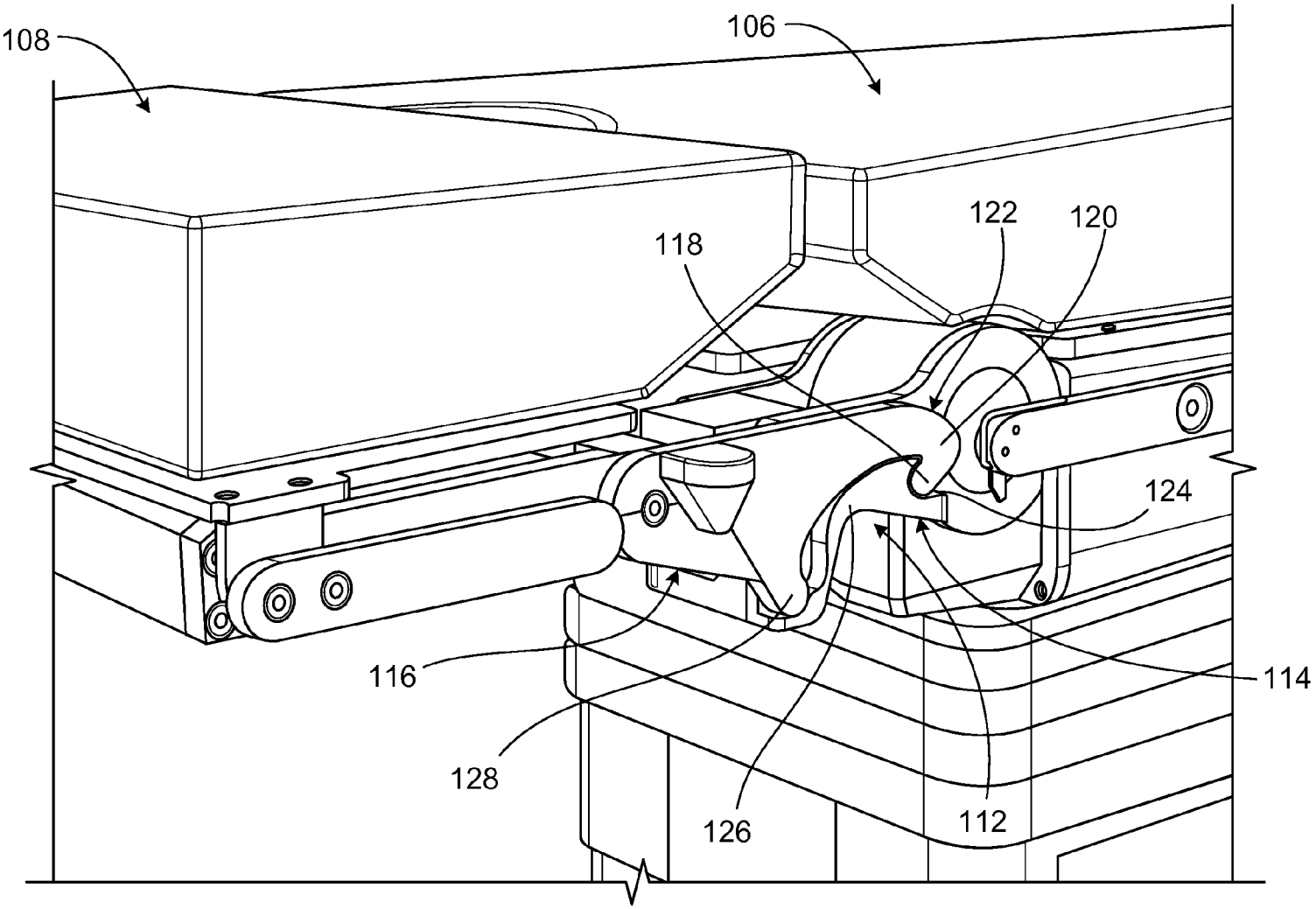
FIG. 2 is an enlarged view of a region of the operating table of FIG. 1 in which one of the coupling devices couples a head component of the table top assembly to a seat and back component of the table top assembly.

FIG. 2 is an enlarged view of the coupling device 112 that couples the right side of the seat and back component 106 to the right side of the head component 108. The coupling device 112 is made up of a receiver assembly 114 that is attached to the frame of the seat and back component 106 and a hook assembly 116 that is attached to the frame of the head component 108. The receiver and hook assemblies 114, 116 can be attached to the frames of their respective table top components 106, 108 using various different types of mechanical fasteners (e.g., screws, bolts, rivots, etc.) and/or bonds (e.g., thermal bonds, such as ultrasonic bonds). The hook assembly 116 and the receiver assembly 114 matingly engage one another to releasably secure the head component 108 to the seat and back component 106. More specifically, as shown in FIG. 2, a tip portion 118 of a crook 120 of a hook member 122 of the hook assembly 116 is secured within a notch or undercut 124 formed by a lateral projection 126 of the receiver assembly 114 to secure the hook assembly 116 to the receiver assembly 114 and thereby secure the head component 108 to the seat and back component 106. A lobe 128 formed in the bottom region of the hook member 122 also engages a depression 130 formed by the lateral projection 126 to further secure the hook assembly 116 to the receiver assembly 114. As will be described below, the hook assembly 116 also includes a spring-loaded pin that engages an aperture formed in the receiver assembly 114 to secure those assemblies to one another.

Figure 3:
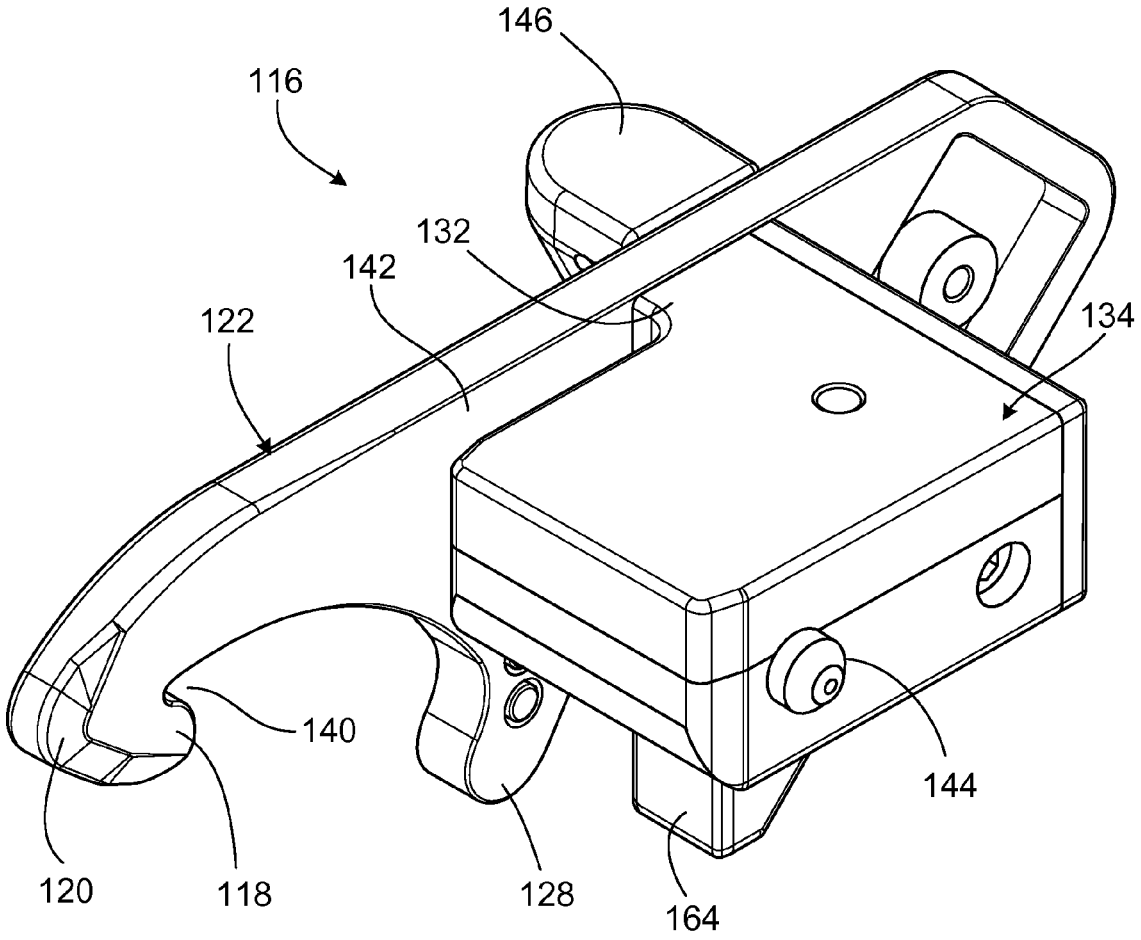
FIG. 3 is an inner perspective view (from above) of a hook assembly of the coupling device shown in FIG. 2.

FIG. 3 is an inner perspective view (from above) of the hook assembly 116 of the coupling device 112 used to secure the right side of the head component 108 to the right side of the seat and back component 106. As shown in FIG. 3, the elongate hook member 122 of the hook assembly 116 is secured to an outer side wall extension 132 of a box-shaped housing 134. The hook member 122 is typically secured to the housing 134 using bolts. However, other types of mechanical fasteners, such as screws or rivots, can alternatively be used to secure those components together. As a further alternative, certain types of bonds, including thermal bonds (e.g., laser welds), can be used in some cases to secure the hook member to the housing.

Figure 4:
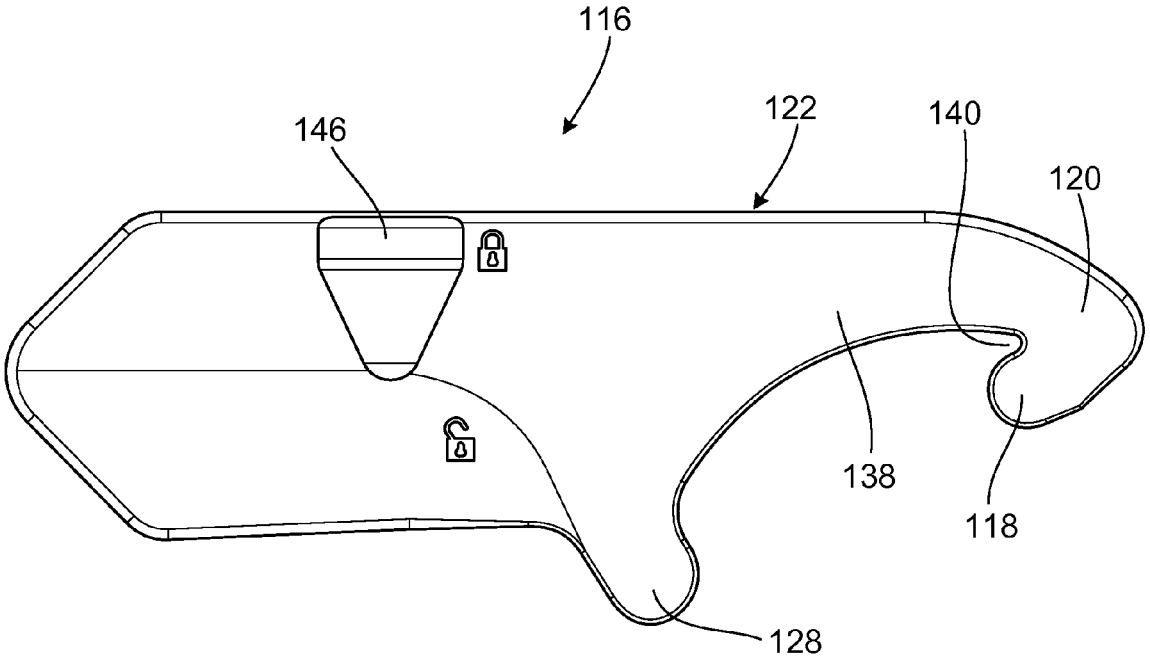
FIG. 4 is an outer side view of the hook assembly of the coupling device shown in FIG. 2.

Referring to both FIG. 3 and FIG. 4, which is an outer side view of the hook assembly 116, the hook member 122 includes a J-shaped hook portion that extends from a central area of the hook member 122. The J-shaped hook portion includes a stem-like member 138 that extends from the central area of the hook member 122 and the crook 120, which extends from the stem-like member 138. The tip portion 118 of the crook 120 bends back toward the central area of the hook member to form a notch 140. The lobe 128 extends downwardly from the central area of the hook member 122. An end region of the hook member 122 opposite the crook 120 is affixed to the frame of the head component 108. As a result, the hook member 122 is rigidly fixed to the frame of the head component 108 such that the hook member 122 is substantially prevented from moving relative to the frame. Typically, bolts are used to secure the hook member 122 to the frame of the head component 108. However, other types of mechanical fasteners, such as screws and rivots, can alternatively be used. As a further alternative, certain types of bonds, including thermal bonds (e.g., laser welds), can be used in some cases to secure the hook member to the frame.

The hook member 122 is typically sized so that it does not significantly impact the ability of a use to slide accessories on and off a side rail of the table that is adjacent the hook member 122 when the hook assembly 116 is coupled to the receiver assembly 114. In some embodiment, the hook member has a thickness of about 11 mm.

As shown in FIG. 3, due to the side wall extension 132 of the housing 134 to which the hook member 122 is attached, a gap 142 is formed between a length of the housing 134 and the central region of the hook member 122. The gap 142 is sized to receive a wall of the receiver assembly 114 when the hook assembly 116 and the receiver assembly 114 are matingly engaged with one another. As will be discussed below, this arrangement helps to secure the hook assembly 116 laterally with respect to the receiver assembly 114.

Still referring to FIG. 3, a spring-loaded pin 144 is partially disposed within the housing 134 and is biased into an extended position in which the pin 144 protrudes inwardly from an inner side surface of the housing 134. The pin 144 can be pushed into the housing 134 by applying a force to the exposed portion of the pin 144 in an outward direction (i.e., in a direction toward the hook member 122). Upon releasing that force, the pin 144 will be urged back towards its extended position.

Figure 5:
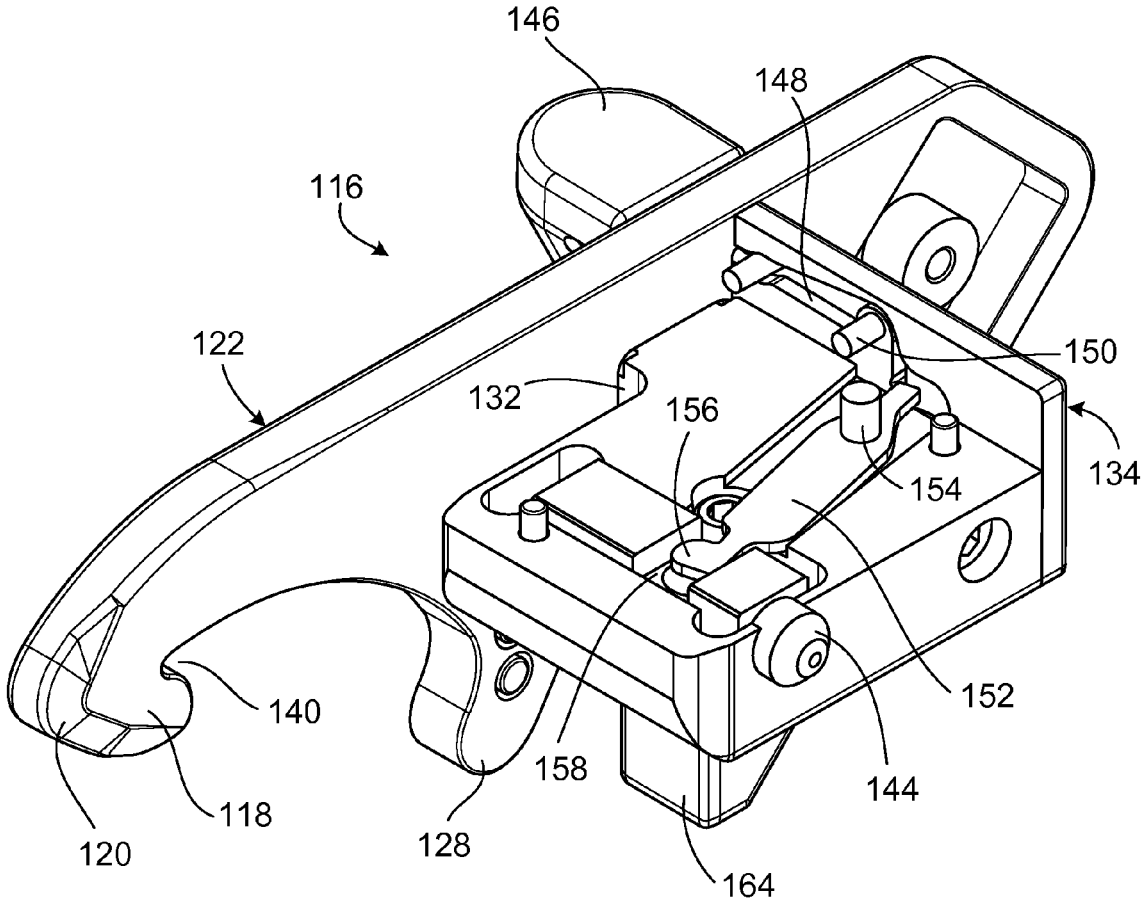
FIG. 5 is an inner perspective view (from above) of the hook assembly of the coupling device shown in FIG. 2 with a top cover of the housing removed to show certain actuator assembly components within the housing.

In addition to being depressed by an outward force applied to the pin 144, the pin 144 can be moved from the extended position to a retracted position and vice versa through operation of an actuator assembly that includes an actuator 146 located on the outer surface of the hook member 122. As shown in FIG. 5, which shows the hook assembly 116 with the top cover of the housing 134 removed, the actuator 146 is attached to a transverse pivotable lever 148 that extends through vertical slots formed in the hook member 122 and the housing 134. When the actuator 146 is pushed down, the lever 148 pivots about a pin 150 that is fixed to the end wall of the housing 134. This movement causes the end of the lever 148 to engage the end of a longitudinal pivotable lever 152 that extends generally along the length of the housing 134. The movement of the end of the transverse lever 148 causes the end of the longitudinal lever 152 to move toward the inner side wall of the housing 134 (i.e., away from the actuator 146). As a result, the longitudinal lever 152 is pivoted about a pin 154 that is fixed to and extends downward from the top cover of the housing 134. The end of the longitudinal lever 152 opposite the end engaged by the transverse lever 148 is in the form of a cam 156 that sits within a channel 158 formed in a block-shaped portion of the spring-loaded pin 144. Due to this arrangement, as the longitudinal lever 152 is pivoted about the pin 154 by pressing down on the actuator 146, the spring-loaded pin 144 is retracted into the housing 134. From this position, the spring-loaded pin 144 can similarly be extended out of the housing 134 by applying an upward force to the actuator 146.

Figure 6:
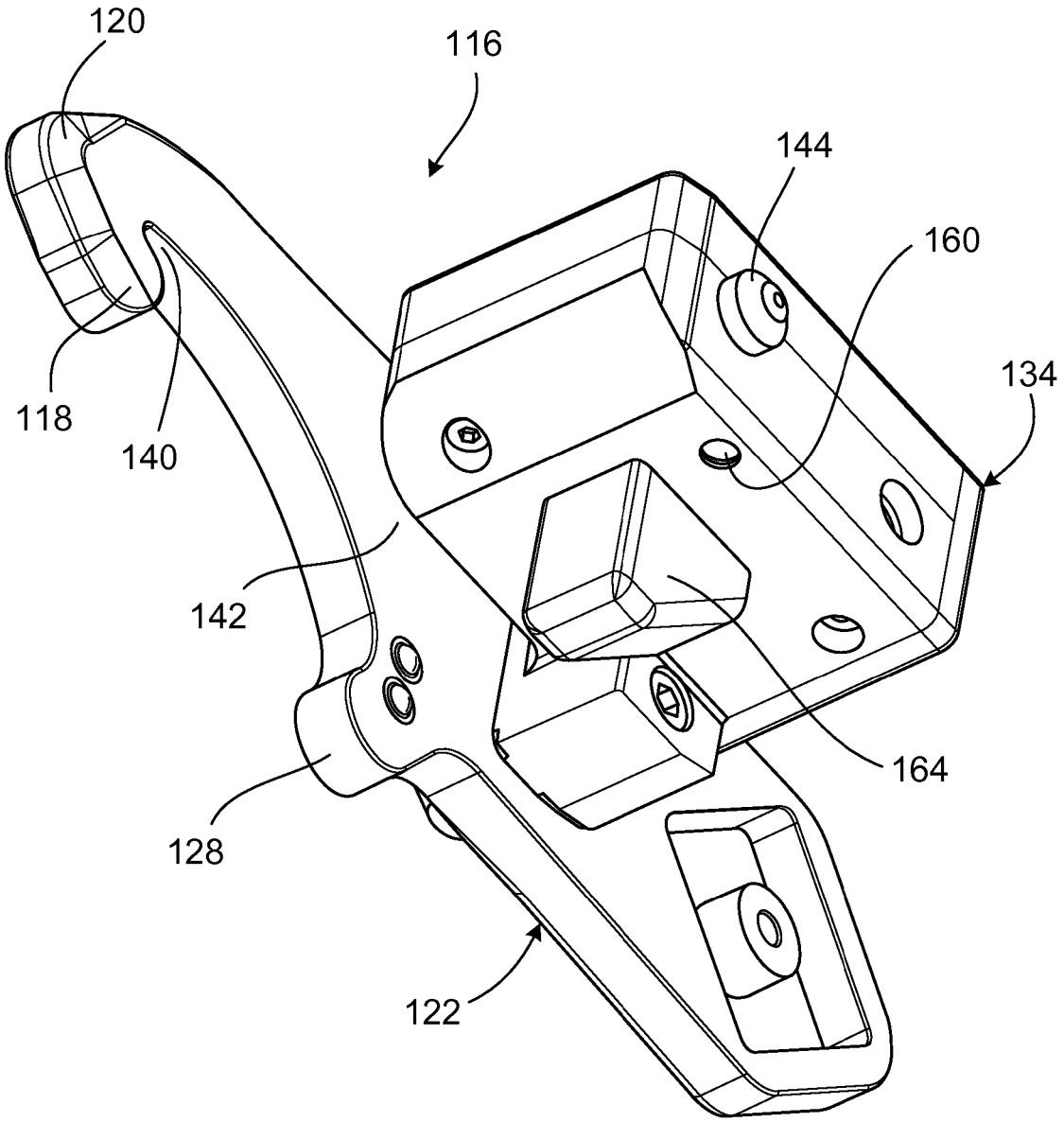
FIG. 6 is an inner perspective view (from below) of the hook assembly of the coupling device shown in FIG. 2.

Referring to FIG. 6, which is an inner perspective view (from below) of the hook assembly 116, a ball spring 160 protrudes slightly from a bottom surface of the housing 134. The ball spring 160 can be pushed into the housing 134 by applying an upward force to the ball spring 160. When the spring-loaded pin 144 is in the retracted position and the ball spring 160 is pressed into the housing 134, the ball spring 160 engages the pin 144 in a manner to retain the pin 144 in the retracted position.

Figure 7:
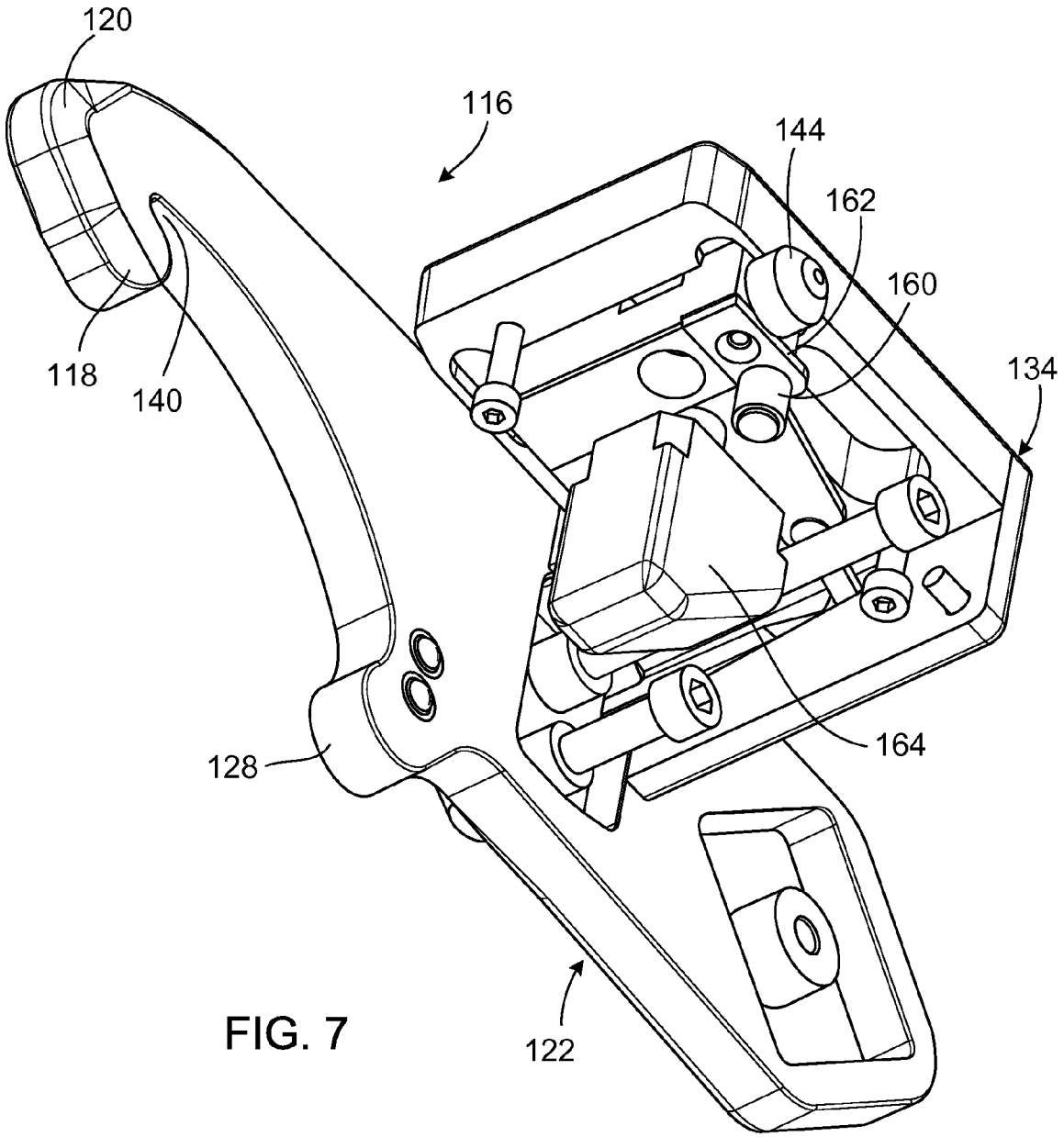
FIG. 7 is an inner perspective view (from below) of the hook assembly of the coupling device shown in FIG. 2 with a bottom cover of the housing removed to show a locking mechanism within the housing.

As shown in FIG. 7, which is an inner perspective view (from below) of the hook assembly 116 with the bottom cover of the housing 134 removed, the spring-loaded pin 144 includes a tab or plate 162 that is attached to the block-shaped portion of the pin 144 and extends rearwardly from the pin 144. As the pin 144 is caused to retract by either applying a downward force to the actuator 146 or by applying an outward force (i.e., a force in the direction of the hook member 122) to the pin 144 itself, the tab 162 is caused to slide along the top of the ball spring 160. Once the tab 162 has passed outwardly beyond the ball spring 160, the ball spring 160 extends upward and engages the inner side surface of the tab 162. This contact between the ball spring 160 and the inner side surface of the tab 162 prevents the pin 144, which is constantly being urged towards its extended position, from moving from its retracted position to its extended position.

Referring again to FIG. 6, a boss 164 also protrudes from the bottom surface of the housing 134. The size of the boss 164 depends on the type of table top component to which the hook assembly 116 is attached. For example, table top components that are heavy or will produce large loads during use are equipped with hook assemblies 116 that include large bosses 164, while table top components that are light or will produce small loads during use are equipped with hook assemblies 116 that include smaller bosses 164. As will be described below, each of the receiver assemblies 114 includes an opening or window 166 (shown in FIG. 8) arranged to receive the boss 164 of an associated hook assembly 116 when those assemblies are matingly engaged. Receiver assemblies 114 that are attached to table top components that are capable of bearing large loads include large openings 166, while receiver assemblies that are attached to table top components that are capable of bearing only small loads include small openings 166. In this way, the table top components that are light or that will only produce small loads during use can be coupled to table top components that are capable of bearing small loads and to table top components that are capable of bearing large loads. In contrast, heavy table top components or table top components that are intended produce large loads during use cannot be coupled to table top components that are only capable of bearing small loads because the bosses 164 of those heavy table top components will be too large to fit within the openings 166 of the table top component that are designed to only bear small loads. Because the hook assembly 116 that is secured to the head component 108 is intended for use with the receiver assembly 114 that is secured to the seat and back component 106, the boss 164 of the hook assembly 114 illustrated in FIG. 6 is able to pass through the opening 166 of the receiver assembly 114 shown in FIG. 8.

Figure 8:
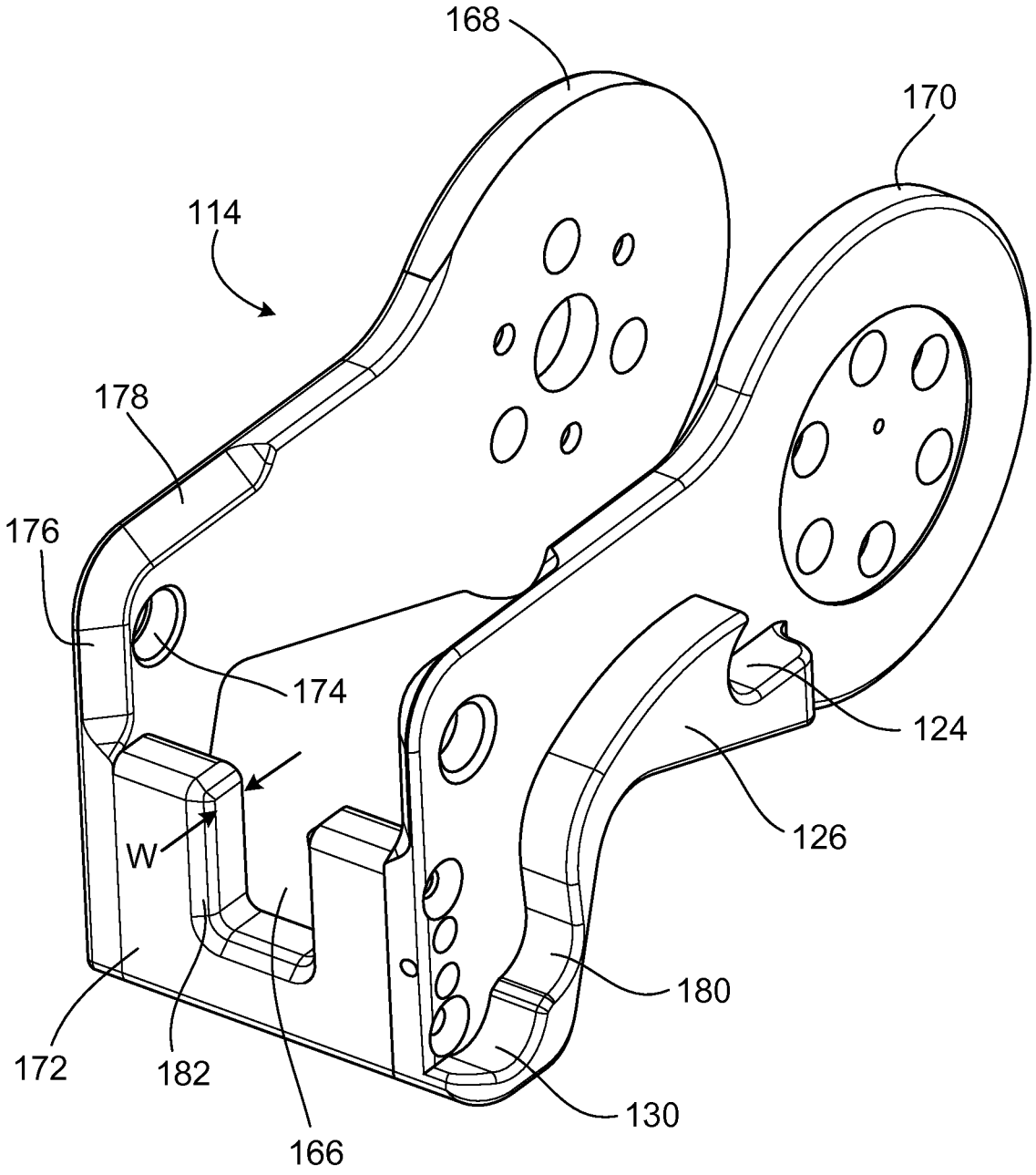
FIG. 8 is an outer perspective view (from above) of a receiver assembly of the coupling device shown in FIG. 2.

FIG. 8 is a top perspective view of the receiver assembly 114. The receiver assembly 114 includes an inner vertical wall 168, an outer vertical wall 170, and a transverse wall 172 that extends between the inner and outer walls 168, 170. The walls 168, 170, 172 are typically fastened together using bolts. Similarly, bolts are typically used to fasten the inner wall 160 of the receiver assembly 114 to the frame of the seat and back component 106. However, other types of mechanical fasteners, such as screws and rivots, can alternatively be used. As a further alternative, certain types of bonds, including thermal bonds (e.g., laser welds), can be used in some cases to secure the walls 168, 170, 172 to one another and/or to secure the inner wall 168 to the frame of the seat and back component 106.

As shown in FIG. 8, an end region of the inner wall 168 includes a through-hole 174 that is sized and shaped to receive the spring-loaded pin 144 of the hook assembly 116. The edges of the inner wall 168 in the region of the leading upper corner of the inner wall 168 are chamfered to form ramps 176, 178 that are angled toward the central space between the inner and outer walls 168, 170. These edges can, for example, extend at about 30 degrees to about 60 degrees (e.g., about 45 degrees) relative to the plane in which the inner wall 168 lies. The ramps or angled edges 176, 178 of the inner wall 168 apply a force to the spring-loaded pin 144 as the hook assembly 116 is being coupled to the receiver assembly 114. Due to the geometry of the ramps 176, 178, the ramps 176, 178 can gradually depress the spring-loaded pin 144 from its extended position to its retracted position as the spring-loaded pin 144 slides along the ramps 176, 178 toward the through-hole 174. As described below, this allows the spring-loaded pin 144 to become aligned with and extend into the through-hole 174 when the hook assembly 116 is coupled with the receiver assembly 114.

Figure 9:
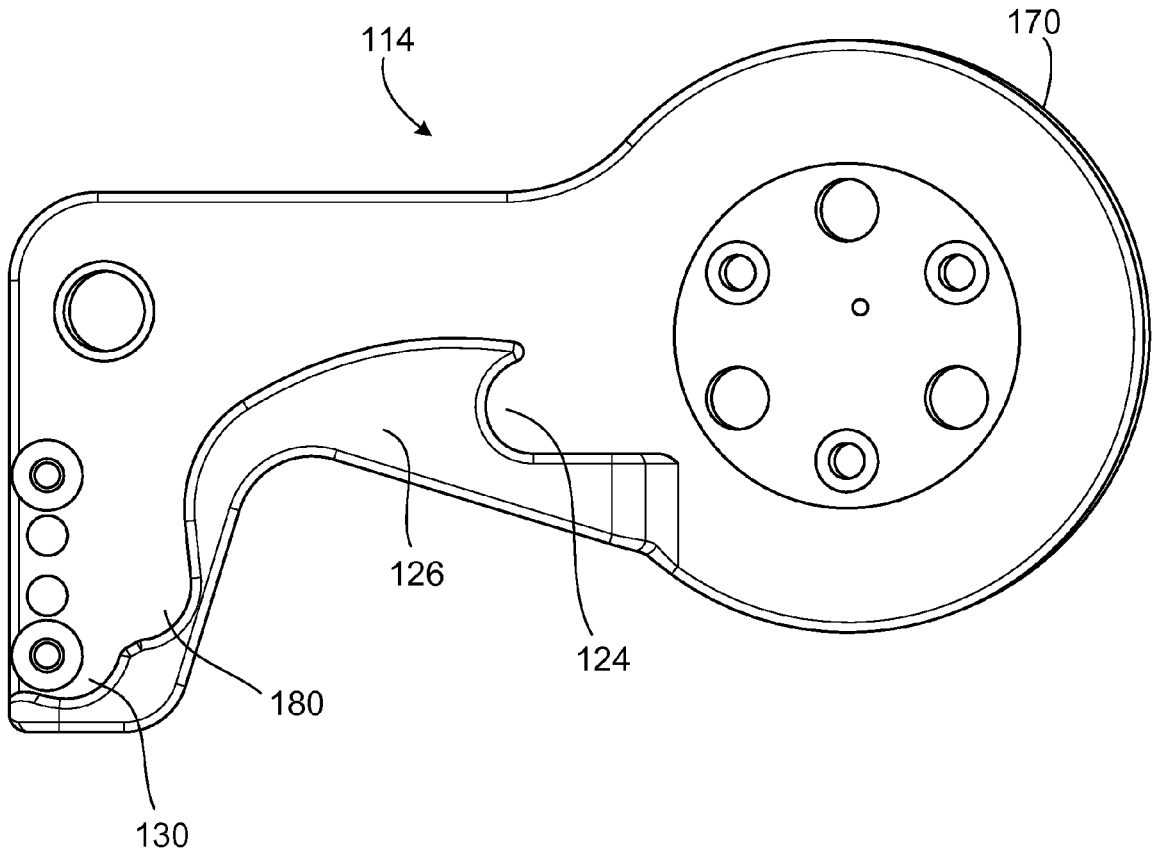
FIG. 9 is an outer side view of the receiver assembly of the coupling device shown in FIG. 2.

Referring to both FIG. 8 and FIG. 9, which is an outer side view of the receiver assembly 114, the lateral projection 126 of the receiver assembly 114 extends outwardly from the outer surface of the outer wall 170. The end region of the lateral projection 126 opposite the transverse wall 172 forms the notch or undercut 124 in which the tip portion 118 of the hook member 122 is received when the hook assembly 116 and the receiver assembly 114 are coupled. The notch 124 is sized and shaped such that the portion of the lateral projection 126 that forms the notch 124 can matingly engage the tip portion 118 of the hook member 122 and thus limit movement of the hook member 122 relative to the receiver assembly 114. An upper surface of a central region of the lateral projection 126 is curved and can serve as a ramp along which the crook 120 of the hook member 122 slides when the hook assembly 116 is being coupled to the receiver assembly 114. The end region of the lateral projection 126 opposite the notch 124 includes the lower rounded depression 130 and an upper rounded depression 180. The upper and lower rounded depressions 130, 180 are generally sized and shaped to receive the lobe 128 of the hook assembly 116 when the hook assembly 116 is coupled to the receiver assembly 114. As will be described in greater detail below, the lobe 180 of the hook assembly 122 can be disposed within the upper depression 180 during an intermediate phase of coupling the hook assembly 116 to the receiver assembly 114 and can be disposed within the lower depression 130 once the coupling process is complete.

Typically, the lateral projection 126 is integrally formed with the outer wall 170. For example, the outer wall 170 and the lateral projection 126 can be die cast, injection molded, or machined from a single plate of material. However, the lateral projection 126 and the outer wall 170 can alternatively be formed as separate components that are secured to one another using mechanical fasteners, such as bolts or screws, or using thermal bonding techniques, such as laser welding.

As noted above, the opening or window 166 that receives the boss 164 that extends from the bottom surface of the housing 134 of the hook assembly 116 when the hook assembly 116 is coupled to the receiver assembly 114 is formed in the transverse wall 172. The size of the opening 166 depends on the type of table top component to which the receiver assembly 114 is attached. Receiver assemblies 114 used on table top components capable of bearing heavy loads will generally have large openings 166, while receiver assemblies 114 used on table top components capable of bearing only light loads will generally have small openings 166. This can ensure that hook assemblies 116 that are coupled to heavy table top components or table top components that will be subjected to heavy loads during use (i.e., hook assemblies that have large bosses 164 extending from their housings) can only be coupled to receiver assemblies 114 attached to table top components that are capable of bearing large loads. The large bosses 164 extending from the housings 134 of hook assemblies 116 attached to such heavy table top components would be too large to fit within the small openings 166 in the transverse walls 172 of receiver assemblies 114 that are used with table top components that are only capable of bearing small loads. As discussed above, because the hook assembly 116 that is secured to the head component 108 is intended for use with the receiver assembly 114 that is secured to the seat and back component 106, the boss 164 of the hook assembly 114 illustrated in FIG. 6 is able to pass through the opening 166 of the receiver assembly 114 shown in FIG. 8.

Still referring to FIG. 8, the top surface of the transverse wall 172 is configured to contact the ball spring 160 extending from the bottom surface of the housing 134 of the hook assembly 122 to hold the ball spring 160 in a depressed state when the hook assembly 116 is coupled to the receiver assembly 114. As discussed above, depressing the ball spring 160 in this manner can serve to hold the spring-loaded pin 144 that extends from the side surface of the housing 134 of the hook assembly 116 in its retracted position. Typically, the top surface of the transverse wall 172 has a width w of about 0.31 inch to about 0.75 inch (e.g., about 0.5 inch) to ensure that the transverse wall 172 remains in contact with the ball spring 160 when the hook assembly 116 is coupled to receiver assembly 114. The front face of the transverse wall 172 also includes lead ins or chamfers 182 along the top of the wall and around the opening 166. The chamfers 182 can, for example, extend at an angle of about 30 degrees to about 60 degrees (e.g., about 45 degrees) relative to the vertical plane in which the transverse wall 172 lies. The chamfers 182 facilitate alignment of the boss 164 of the hook assembly 116 as the housing 134 of the hook assembly is slid into the space between the inner and outer walls 168, 170 during coupling of the hook assembly 116 to the receiver assembly 114. The chamfers 182 also facilitate depression of the ball spring 160 that extends from the bottom of the housing 134 as the ball spring 160 slides into engagement with the transverse wall 172.

Figure 10:
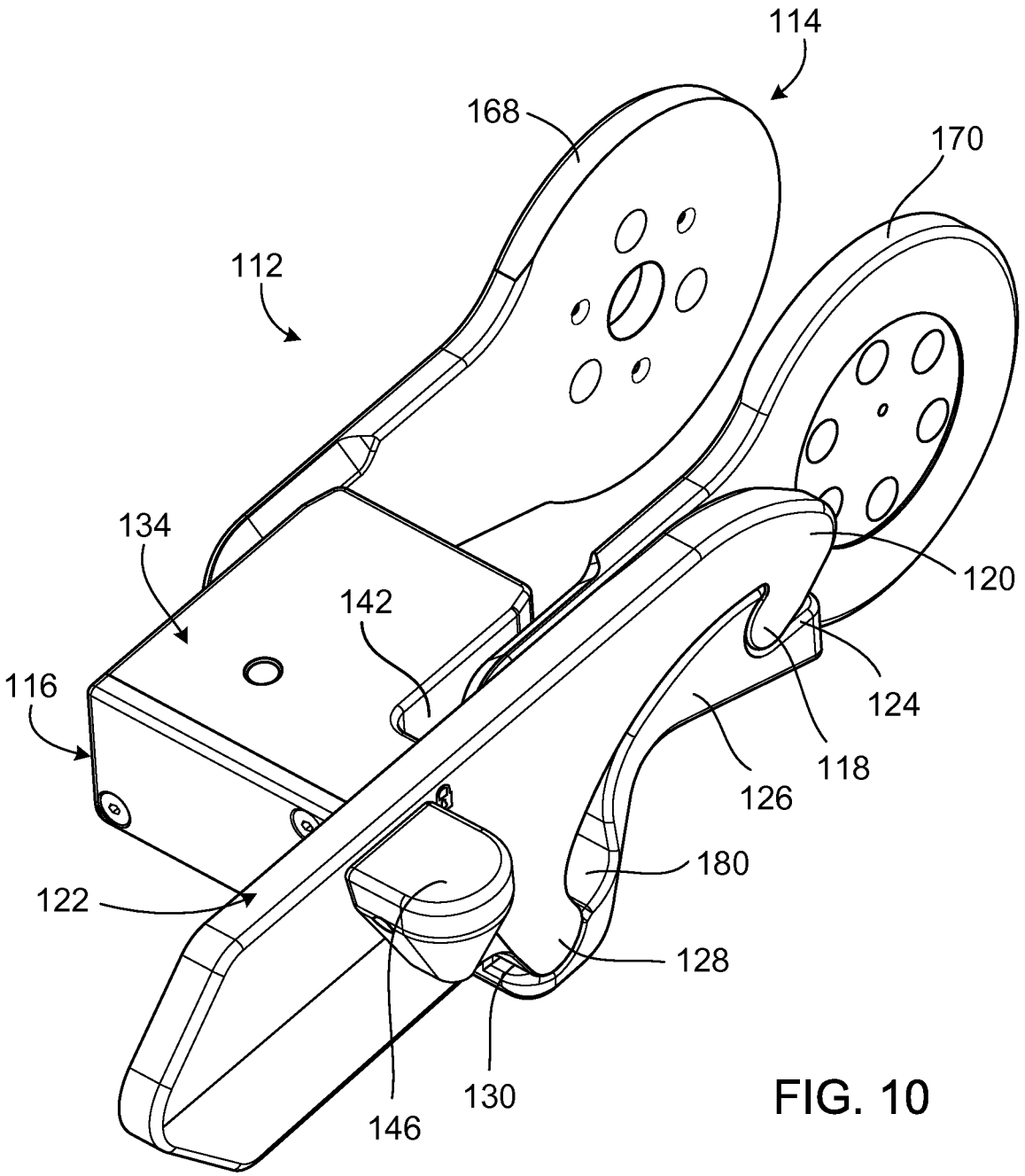
FIGS. 10 and 11 are outer and inner perspective views, respectively, of the coupling device shown in FIG. 2, in a coupled configuration.
Figure 11:
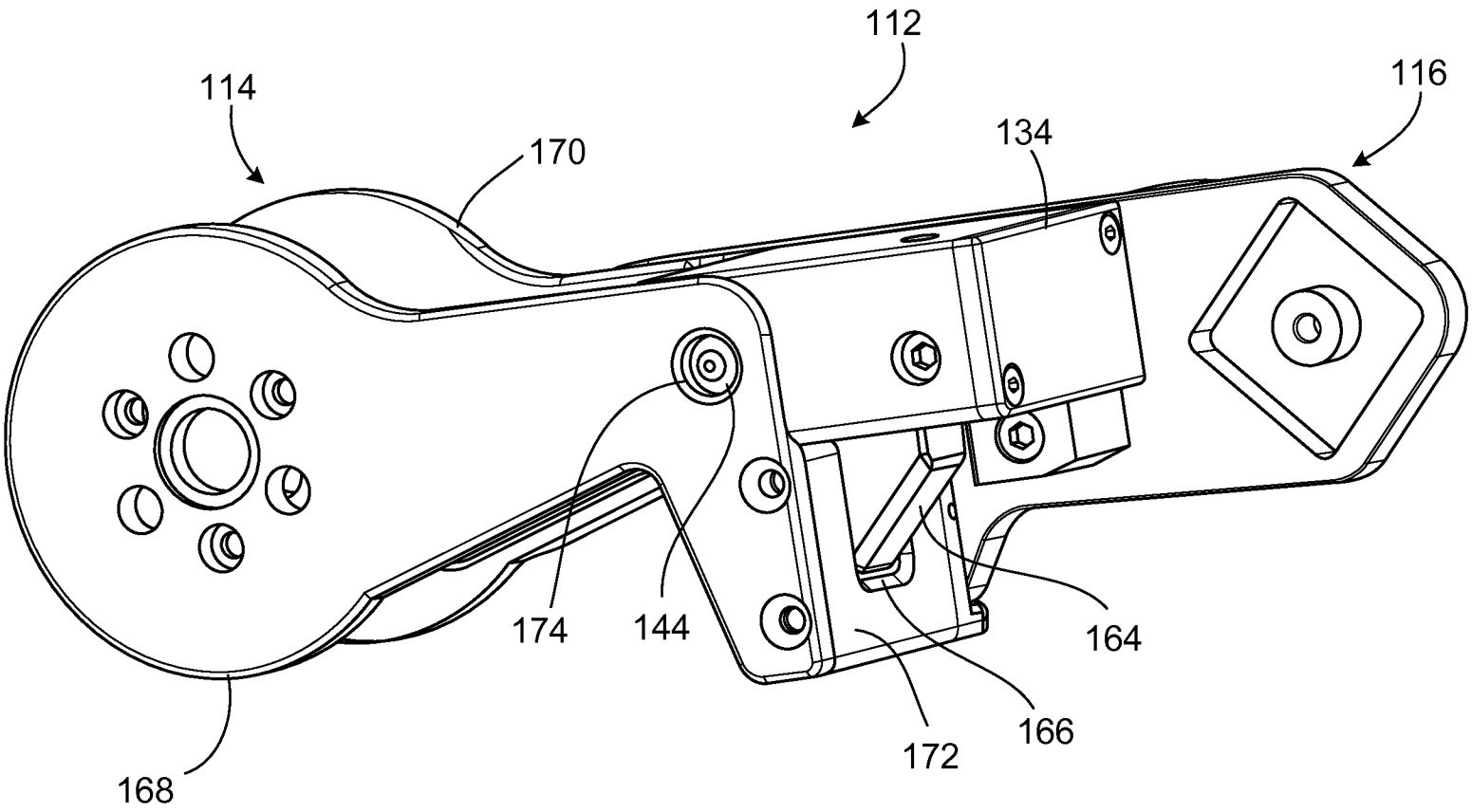
Figure 12:
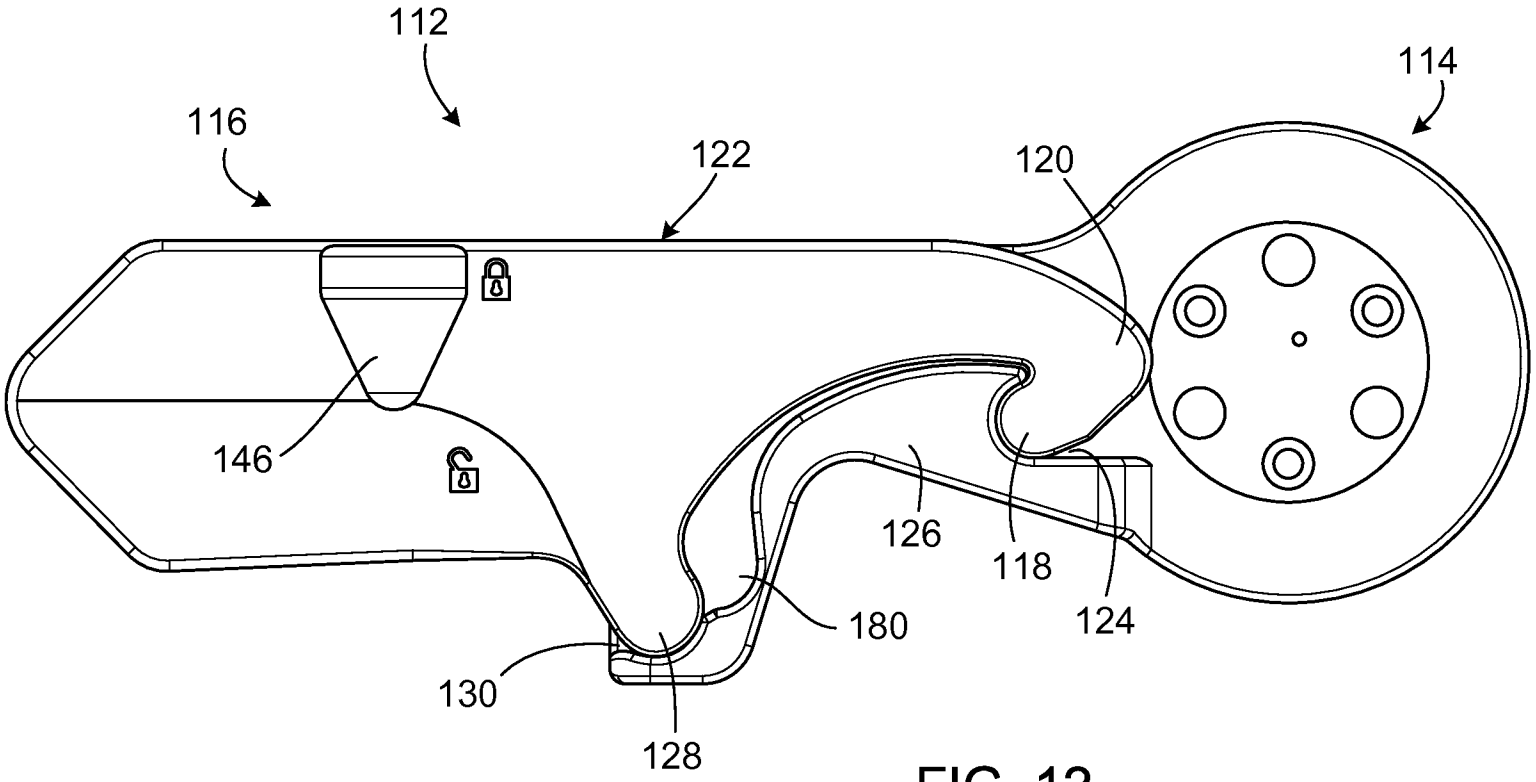
FIG. 12 is an outer side view of the coupling device shown in FIG. 2, in the coupled configuration.

FIGS. 10 and 11 are perspective views of the coupled hook assembly 116 and receiver assembly 114 from the outer side and inner side, respectively, of the coupling device 112. FIG. 12 is a side view of the coupling device 112 in the coupled configuration. As shown in FIGS. 10 and 12, in this coupled configuration, the tip portion 118 of the crook 120 of the hook member 122 sits within the notch 124 formed by the lateral projection 126 of the receiver assembly 114, and the lobe 128 of the hook member 122 sits within the lower depression 130 formed by the lateral projection 126. The mated engagement of the tip portion 118 of the hook member 122 with the notch 124 helps to prevent inadvertent rearward, upward, and downward forces applied to the hook assembly 116 from disengaging the hook assembly 116 from the receiver assembly 114. Similarly, the engagement of the lobe 128 with the lower depression 130 helps to prevent inadvertent forward forces applied to the hook assembly 116 from disengaging the hook assembly 116 from the receiver assembly 114.

The actuator 146 of the hook assembly 116, as shown in FIGS. 10 and 12, is in its upper position indicating that the spring-loaded pin 144 of the hook assembly 116 is extended into the through-hole 174 formed in the inner wall 168 of the receiver assembly 114 to lock the hook assembly 116 to the receiver assembly 114. FIG. 11 shows the spring-loaded pin 144 protruding into the through-hole 174 of the inner wall 168.

As shown in FIG. 10, when the hook assembly 116 and the receiver assembly 114 are coupled together, the housing 134 of the hook assembly 116 sits within the central space between the inner and outer walls 168, 170 of the receiver assembly. The width of the space between the inner and outer walls 168, 170 is typically no more than about 1.5 mm greater than the width of the housing 134. The space can, for example, be about 0.5 mm to about 1.5 mm wider than the housing 134. The width of the gap 142 between the housing 134 and the hook member 122 is typically no more than about 1.0 mm greater than the width of the portion of the outer wall 170 of the receiver assembly 114 that fits therein. The gap 124 can, for example, be about 0.25 mm to about 1.0 mm wider than the outer wall 170. Due to the similar widths of the space between the inner and outer walls 168, 170 and the housing 134 and the similar widths of the gap 142 and the outer wall 170, lateral movement of the hook assembly 116 relative to the receiver assembly 114, which can, for example, result from a surgeon or surgical staff member bumping into the side of the operating table 100 during a procedure, can be limited to acceptable levels.

FIG. 11 shows the boss of the hook assembly disposed within the opening in the transverse wall of the receiver assembly. It is evident that hook assemblies having wider bosses than the boss shown in FIG. 11 (e.g., hook assemblies attached to heavier table top components) would not fit within the opening of the transverse wall. As a result, those hook assemblies could not be coupled with the receiver assembly because the housings of those hook assemblies would not be able to slide far enough into the space between the inner and outer walls of the receiver assembly to allow the spring-loaded pins of those hook assemblies to penetrate the through-hole in the inner wall and to allow the tip portions of those hook assemblies to matingly engage the notch of the receiver assembly.

The various components of the hook assembly 116 and the receiver assembly 114 are typically formed of lightweight materials that are able to withstand the loads that their coupled table top components experience during use. In certain embodiments, for example, the various components of the hook assembly and the receiver assembly are formed of nickel plated aluminum alloy (e.g., 7075-T6 aluminum alloy having a nickel plating on the order of 0.25 mm thick), which is significantly lighter than certain conventional materials, such as stainless steel. By reducing the weight of these components (as compared to similar components formed of certain conventional materials), the overall weight of the head component 108 and the leg component 110 can be reduced. As a result, the surgeon or surgical staff member can more easily hold and maneuver these table top components during the coupling process.

Figure 13:
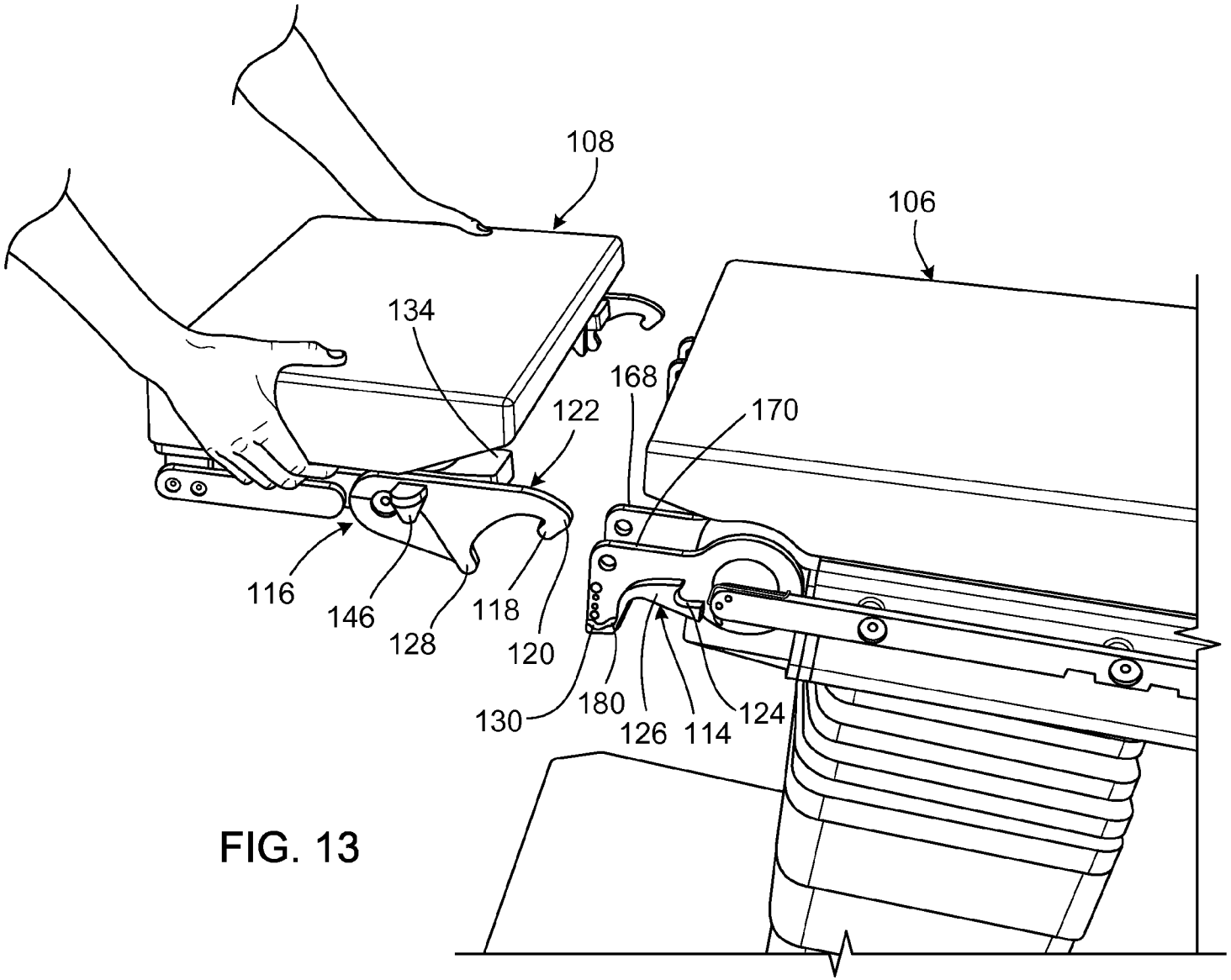
FIGS. 13-16 illustrate a method of coupling the head table top component to the seat and back table top component of the operating table of FIG. 1.

FIGS. 13-16 illustrate a method of securing the head component 108 to the seat and back component 106 by coupling the hook assembly 116 of the head component 108 to the receiver assembly 114 of the seat and back component 106. As shown in FIG. 13, to secure the head component 108 to the seat and back component 106, the head component 108 is grasped by a surgical staff member and moved toward the seat and back component 106. Because the hook assembly 116 extends beyond the frame and the pad of the head component 108 (toward the seat and back component 106), the hook member 122 can be seen from above by the surgical staff member that is grasping the head component 108. Additionally, the receiver assembly 114 extends beyond the frame and the pad of the seat and back component 106 (toward the head component 108) such that the receiver assembly 114 can also be seen from above by the surgical staff member. The surgical staff member aligns the hook assembly 116 with the receiver assembly 114 as he or she moves the head component 108 toward the seat and back component 106. The portions of the hook and receiver assemblies 116, 114 that extend beyond their respective table top components make it easier for the surgical staff member to align the hook assembly 116 with the receiver assembly 114.

Figure 14:
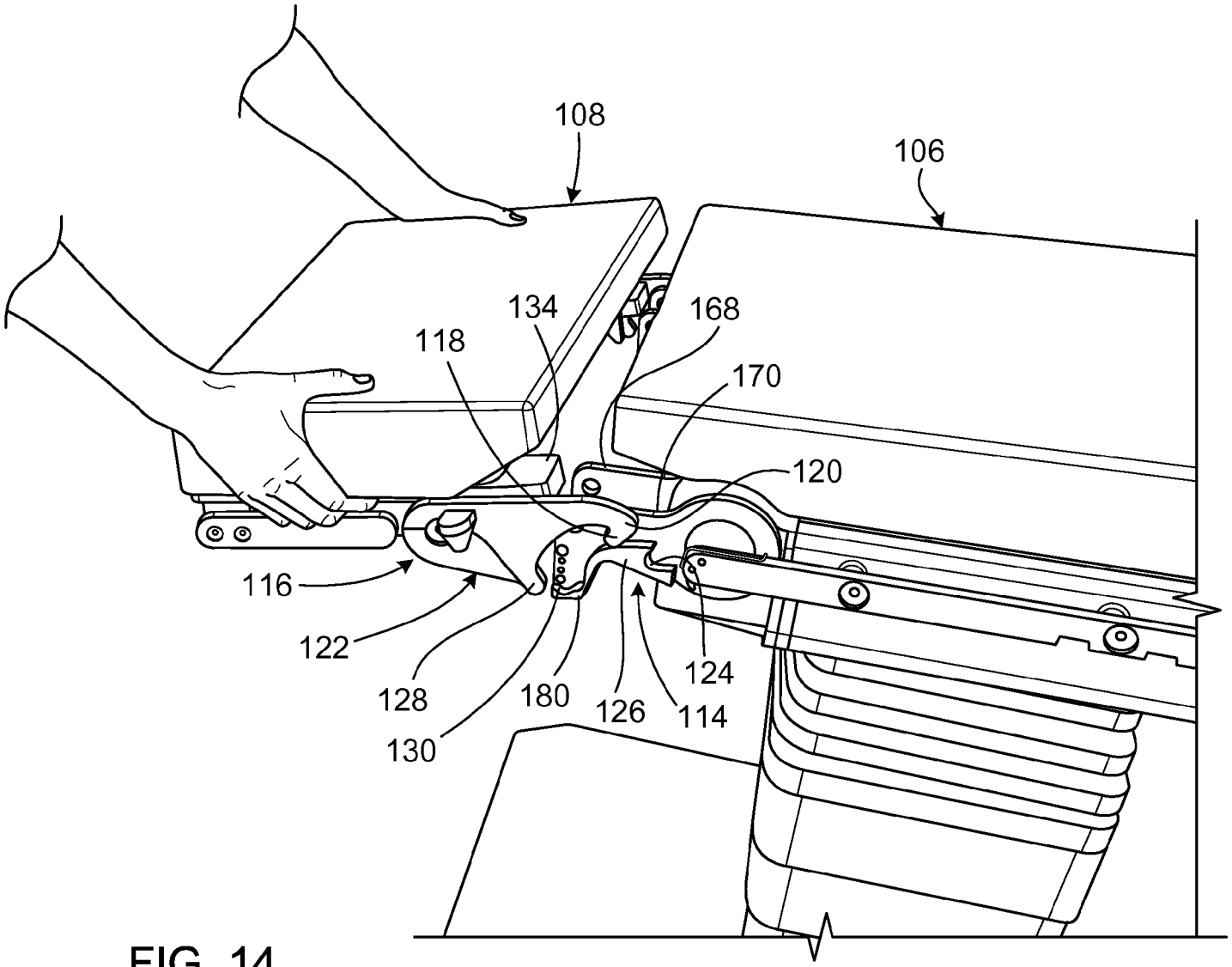

The surgical staff member continues to advance the head component 108 toward the seat and back component 106 until the crook 120 of the hook member 122 of the hook assembly 116 comes into contact with the central region of the lateral projection 126 of the receiver assembly 114, as shown in FIG. 14. Due to this contact between the crook 120 of the hook member 122 and the lateral projection 126, some of the weight of the head component 108 is distributed to the seat and back component 106, which decreases the weight that the surgical staff member must carry. At this point, the surgical staff member pushes the head component 108 further toward the seat and back component 106 such that the crook 120 of the hook member 122 slides along the ramp formed by the lateral projection 126. When the hook member 122 is riding along the lateral projection 126 in this manner, the housing 134 of the hook assembly 116 is aligned with the space formed between the inner and outer walls 168, 170 of the receiver assembly 114. Additionally, the boss 164 extending from the bottom surface of the housing 134 is aligned with the opening 166 formed in the transverse wall 172 that extends between the inner and outer walls 168, 170 of the receiver assembly 116 (shown in FIG. 11). Because the head component 108 is compatible with the seat and back component 106 (i.e., because the seat and back component 106 is designed to bear the weight of the head component 108), the boss 164 is sized to fit in the opening 166. Thus, as the surgical staff member continues to push the head component 108 toward the seat and back component 106, the housing 134 and the boss 164 of the hook assembly 116 slide into the space between the walls 168, 170 and the opening 166, respectively, of the receiver assembly 114.

Figure 15:
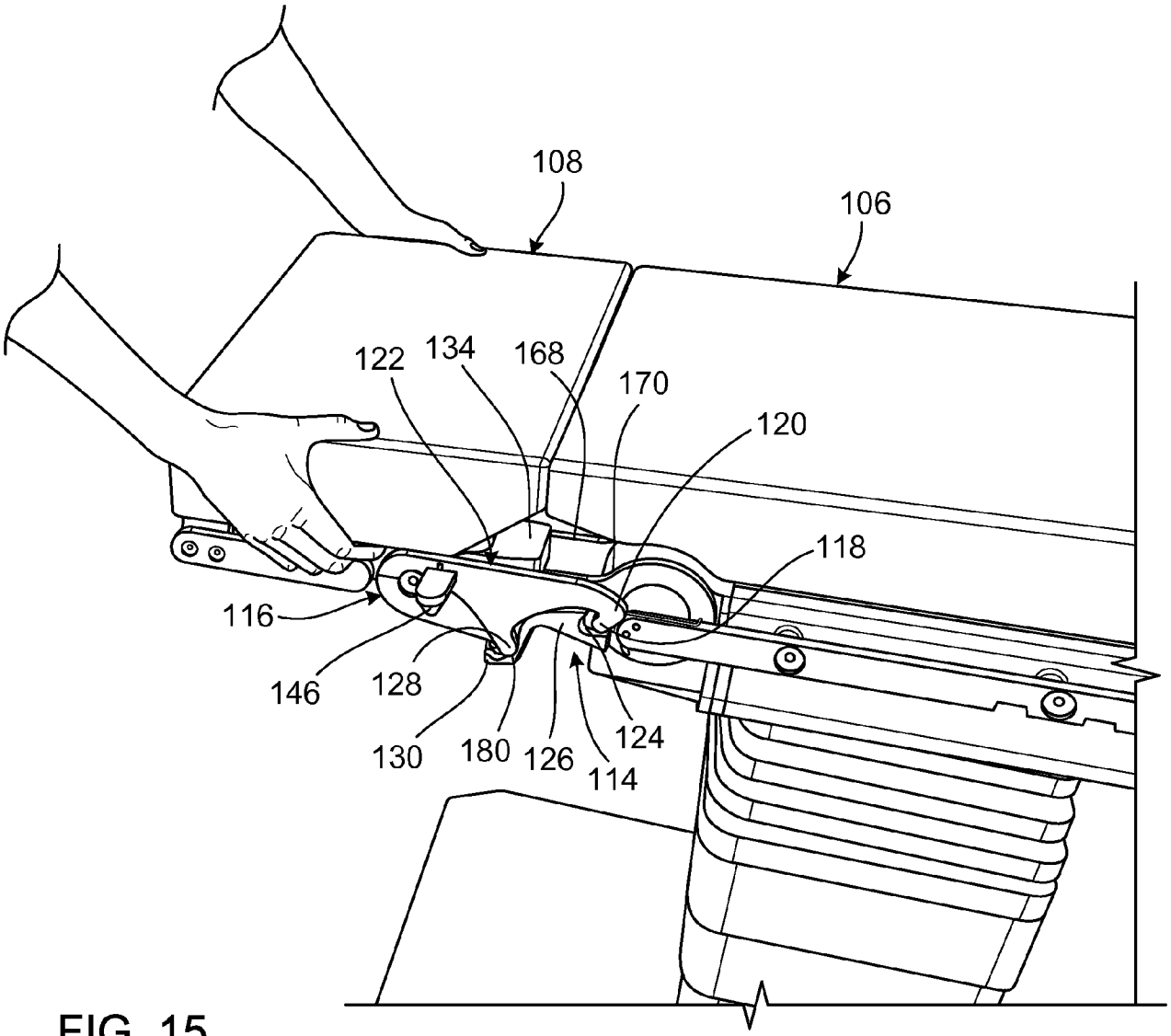

As the surgical staff member continues to push the head component 108 toward the seat and back component 106, the crook 120 of the hook member 122 slides beyond the ramp formed by the central region of the lateral projection 126 and drops into a recessed region at the front of the lateral projection 126, as shown in FIG. 15. At this point, the lobe 128 of the hook member 122 is at least partially disposed in the upper depression 180.

Figure 16:
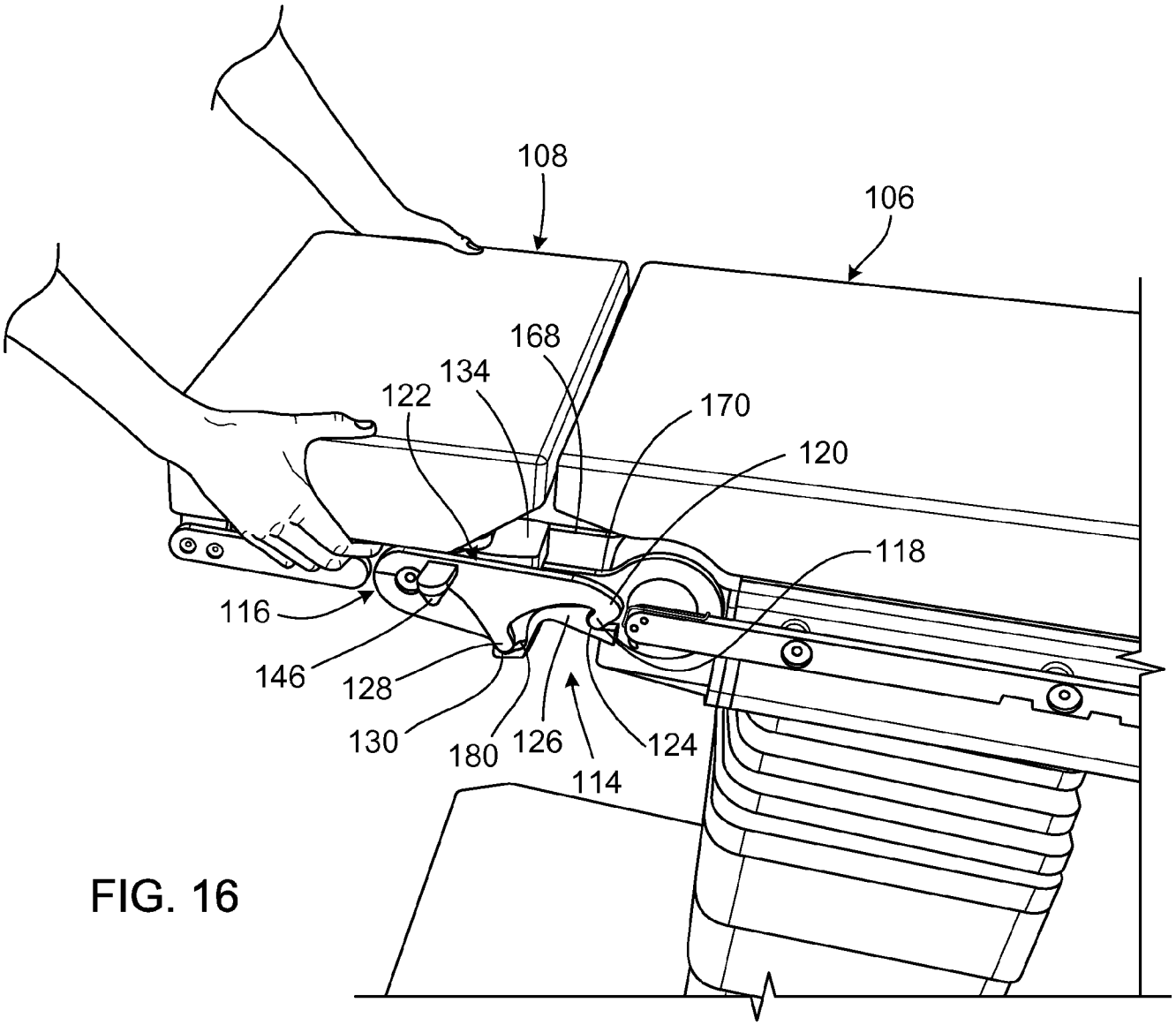

Referring to FIG. 16, the surgical staff member then pulls back on the head component 108 causing the tip portion 118 of the crook 120 to slide into and matingly engage the notch 124 formed by the lateral projection 126. As the user pulls back on the head component 108, the weight of the head component 108 typically causes the lobe 128 to automatically drop down into and matingly engage the lower depression 130. Alternatively, the surgical staff member may apply a downward force to the head component 108 to force the lobe 128 down into engagement with the lower depression 130. As the lobe 128 drops down into the lower depression 130, the spring-loaded pin 144 located along the inner wall of the housing 134 of the hook assembly 116 becomes aligned with the through-hole 174 in the inner wall 168 of the receiver assembly 116 and automatically extends into the through-hole 174 (shown in FIG. 11). This engagement between the spring-loaded pin 144 and the portion of the inner wall 168 that forms the through-hole 174, locks the hook assembly 116 in place relative to the receiver assembly 114 and thus locks the head component 108 in place relative to the seat and back component 106.

Because the hook member 122 and the lateral projection 126 are the outermost components of the hook and receiver assemblies 116 and 114, respectively, in the region in which the hook member 122 and the lateral projection 126 engage with one another, it is possible for someone standing at the side of the operating table to easily determine whether the hook assembly 116 has been properly engaged with the receiver assembly 114 and to thus determine whether the head component 108 has been properly secured to the seat and back component 106.

Figure 17:
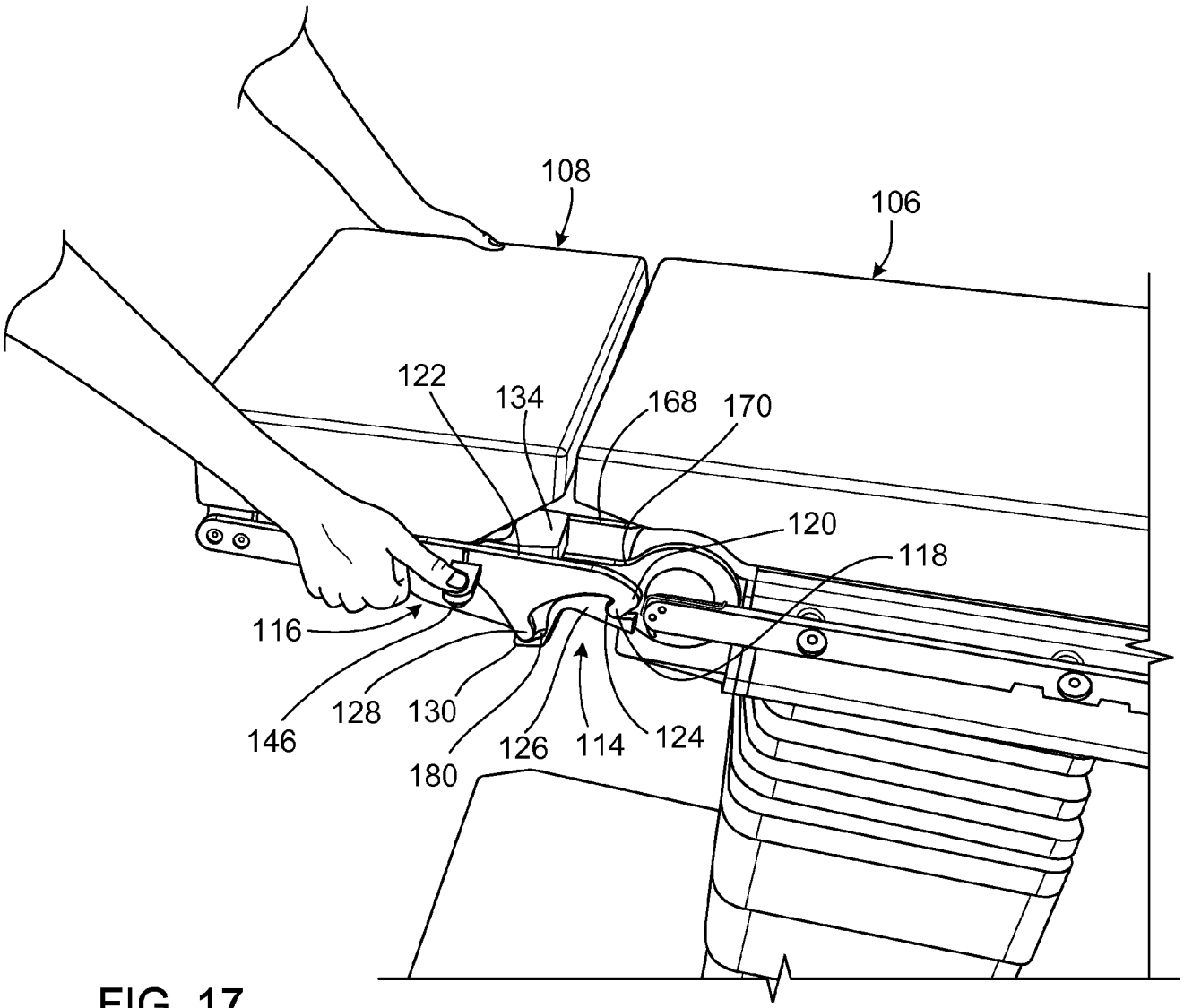
FIG. 17 illustrates an actuator of the hook assembly of the coupling device of FIG. 2 being depressed to decouple the hook assembly from the receiver assembly.

After use of the operating table 100, it may be desirable to remove the head component 108 from the seat and back component 106. This can be done, for example, in order to reconfigure the operating table 100 for a different type of surgical procedure. Referring to FIG. 17, in order to remove the head component 108 from the seat and back component 106, the actuator 146 positioned on the outer surface of the hook member 122 is pressed down to retract the spring-loaded pin 144 of the hook assembly 116. As the spring loaded pin 144 is retracted, the tab 162 extending from the pin 144 slides along the ball spring 160 that is positioned along the bottom surface of the housing 134 (shown generally in FIG. 7). The ball spring is pressed upward by the top surface of the transverse wall 172 of the receiver assembly 114. After the tab 162 of the spring-loaded pin 144 has slid past the ball spring 160, the ball spring 160 extends upward. When the actuator 146 is subsequently released by the surgical staff member, the pin 144 is urged back towards its extended position by an internal spring and the side surface of the tab 162 extending from the pin 144 contacts the ball spring 160. Due to this contact, the pin 144 is locked in its retracted position without the surgical staff member having to hold down the actuator 146. With the pin 144 held in the retracted position, the surgical staff member pulls upward on the head component 108 to remove the lobe 128 of the hook assembly from the lower depression 130 and then pushes the head component 108 toward the seat and back component 106 to remove the tip portion 118 of the crook 120 from the notch 124. The surgical staff member then lifts the head component 108 so that the tip portion 118 of the crook 120 is positioned above the lateral projection 126. The head component 108 is then pulled away from the seat and back component 106 until the hook assembly 116 and the receiver assembly 114 are completely decoupled.

As the housing 134 of the hook assembly 116 is removed from the space between the inner and outer walls 168, 170 of the receiver assembly 114, the ball spring 160 is no longer urged upward by the transverse wall 172 of the receiver assembly 114. As a result, the ball spring 160 drops downward and the spring-loaded pin 144 automatically returns to its extended position. Consequently, there is no need for the surgical staff member to reactivate the pin 144 (e.g., by moving the actuator 146 upward) prior to the next use of the head component 108.

While the methods described with respect to FIGS. 13-17 above relate to mechanically coupling and decoupling the right side hook assembly 116 of the head component 108 and the right side receiver assembly 114 of the seat and back component 106, it should be understood that the left side hook and receiver assemblies of those components would be coupled and decoupled in the same manner.

Figure 18:
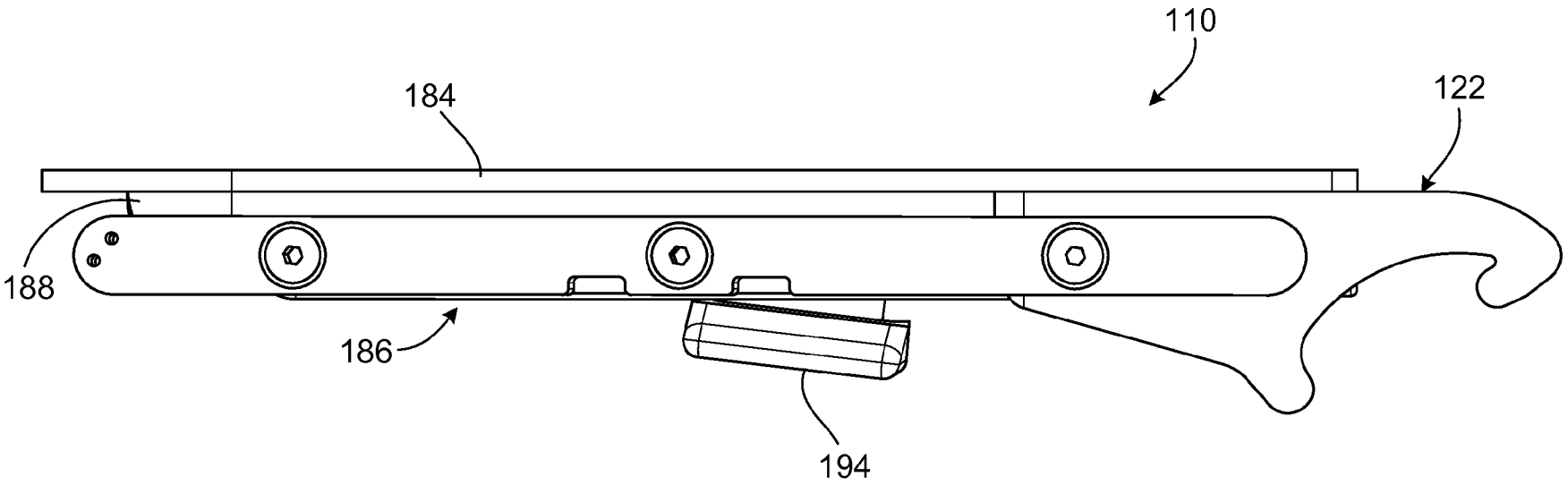
FIG. 18 is an outer side view of a leg component of the table top assembly of the operating table of FIG. 1. The leg component includes right and left hook assemblies secured to sides of a top support board. A top pad member of the leg component has been removed.

FIG. 18 is a left side view of the leg component 110 of the operating table top assembly 104 (shown in FIG. 1). The leg component 110 includes a hook assembly 186 with a rail or spar 188 that is fastened (e.g., via bolts or screws) to a support board 184. The pad that typically rests on top of the support board 184 has been removed for clarity. The hook assembly 186 and an associated receiver assembly positioned along the left side of the seat and back component 106 form the left coupling device 113 (identified in FIG. 1). The receiver assembly that cooperates with the hook assembly 186 to form the coupling device 113 is similar in structure and function to the receiver 114 described above.

Figure 19:
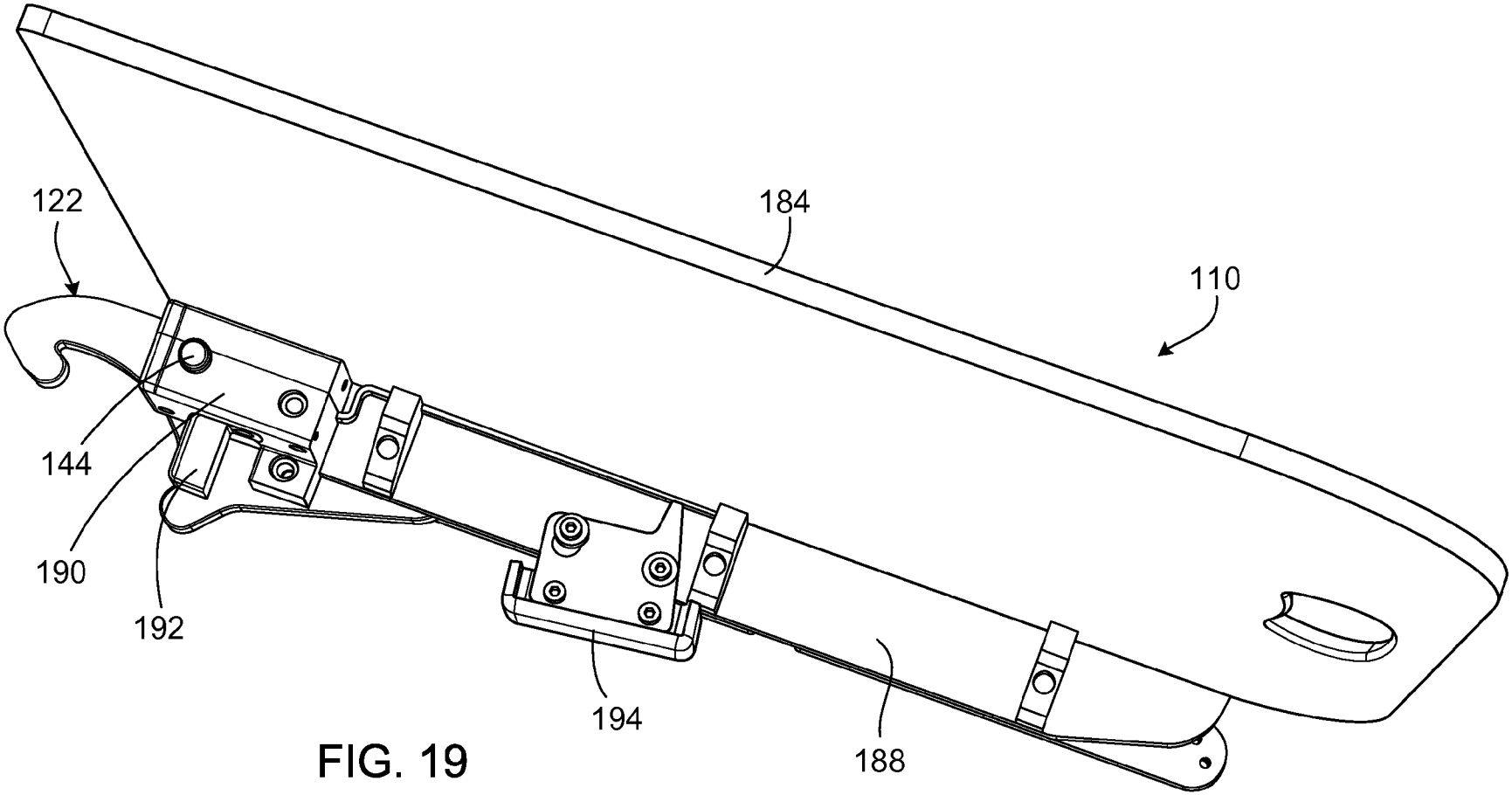
FIG. 19 is an inner perspective view (from below) of the leg component of FIG. 18. The right hook assembly, which is normally secured to the right side of the top support board, has been removed to provide an unobstructed view of the left hook assembly.

FIG. 19 is an inner perspective view (from below) of the leg component 110. The right hook assembly, which is normally secured to the right side of the top support board 184, has been removed to provide an unobstructed view of the left hook assembly 186. Referring to FIGS. 18 and 19, the hook assembly 186 includes the hook member 122 and a housing 190 that are secured to an end region of the rail 188. The housing 190 is similar to the housing 134 described above with respect to the hook assembly 116. However, the housing 190 is slightly modified to accommodate a different type of actuator assembly. The actuator assembly includes, among other components, a graspable lever 194 that is attached to the rail 188 about midway along the length of the leg component 110. As will be described below, the graspable lever 194 can be used to retract the spring-loaded pin 144 into the housing 190 in order to unlock the hook assembly 186 from its associated receiver assembly on the seat and back component 106. In addition, a boss 192 extending from the housing 190 is sized differently than the boss 164 extending from the housing 134 of the hook assembly 116 to indicate that the leg component 110 is heavier than the head component 108.

Figure 20:
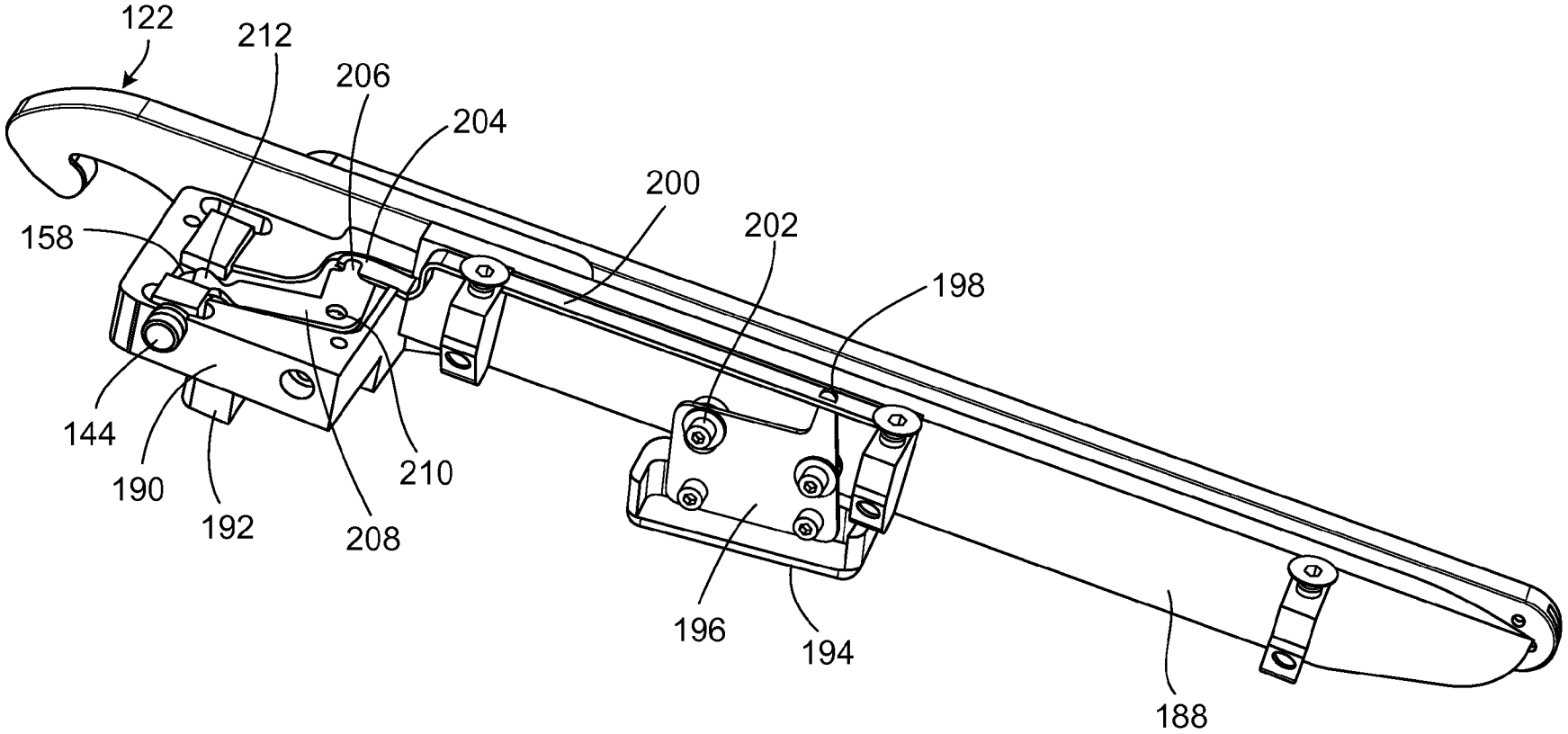
FIG. 20 is an inner perspective view (from above) of the left hook assembly of the leg component of FIGS. 18 and 19 with a top cover of a housing of the hook assembly removed to expose various components of an actuator assembly.

FIG. 20 is an inner perspective view (from above) of the leg component 110 with the support board 184 removed and the top cover of the housing 190 removed to expose various components of the actuator assembly. As shown, the graspable lever 194 includes a plate 196 having a projection 198 that protrudes through an opening in an elongate bar 200 that extends along the length of the rail 188. A pin 202 extending from the inner wall of the rail extends through an elongate angled slot formed in the plate 196. Due to the angle of the elongate slot in the plate 196, as the user squeezes the lever 194 causing the plate 196 to slide along the pin 202, the slot causes the projection 198 extending from the top of the plate 196 to move to the right (in the view shown in FIG. 20). This causes the elongate bar 200 to also move to the right. The end region of the bar 200 opposite the projection 198 extends through a slot formed in the end wall of the housing 190. The end region of the bar 200 is thus disposed within the housing 190 and includes a semi-circular cut out 204 that receives a projection 206 of an L-shaped lever 208 disposed in the housing 190. As the bar 200 moves to the right, the projection 206 of the L-shaped lever 208 is also pulled to the right. This causes the L-shaped lever 208 to pivot about a pin 210 extending downward from the top cover of the housing 190. As a result of this movement, a projection or cam 212 within the channel 158 formed by the block-shaped member of the spring-loaded pin 144 causes the spring-loaded pin 144 to retract within the housing 190. The ball spring 160 (shown in FIG. 7) locks the spring-loaded pin 144 in this retracted position when the hook assembly 186 is matingly engaged with the receiver assembly. Therefore, the user, if desired, can then release his or her grip of the lever 194 and grasp a different portion of the leg component 110 to decouple the hook assembly 186 from the receiver assembly and thus to decouple the leg component 110 from the seat and back component 106.

Apart from squeezing the lever 194 instead of sliding an actuator to retract the spring-loaded pin 144, the operation of the hook assembly 186 is generally the same as the operation of the hook assembly 116 described in detail above. Therefore, the method of coupling the leg component 110 to the seat and back component 106 will not be described in further detail.

While the actuator assembly components disposed within the housing 190 of the hook assembly 186 are slightly different than the actuator assembly components disposed within the housing 134 of the hook assembly 116, in certain implementations, the actuator assemblies of those respective hook assemblies are designed such that the actuator assembly components disposed within the housings of those respective hook assemblies are identical. This can increase the ease and efficiency of manufacturing the various table top components because the same housing can be used for multiple different types of table top components.

While the actuator assemblies used to retract the spring-loaded pins 144 of the hook assemblies 116, 186 discussed above have been described as including slidable levers or squeezable levers, other types of actuators can alternatively be used. Examples of other types of actuators that can be used include quarter turn knobs, depressible paddles, triggers, and spring-loaded cuffs.

While the assembly used to lock the spring-loaded pin 144 in the retracted position has been described as including the ball spring 160 that engages the tab 162 that extends from the spring-loaded pin 144, other types of locking mechanisms can alternatively be used. In some embodiments, for example, the ball spring 160 is arranged to slide along the block-shaped member of the spring-loaded pin 144 and to protrude directly into a recess formed in the block-shaped member of the spring-loaded pin 144 in order to retain the spring-loaded pin 144 in its retracted position. Similarly, while the ball spring 160 has been described as being positioned below the spring-loaded pin 144, in some embodiments, the locking mechanism can alternatively be positioned above the spring-loaded pin 144. In such embodiments, the locking mechanism can include a pin or other projection that, due to gravity, drops into a recess formed along the top surface of the spring-loaded pin 144 as the spring-loaded pin 144 is retracted in order to retain the spring-loaded pin 144 in its retracted position.

While the receiver assembly 114 has been described as being attached to the seat and back component 106 and the hook assemblies 116, 186 have been described as being attached to the head component 108 and the leg component 110, respectively, in certain implementations, hook assemblies are attached to the seat and back component and receiver assemblies are attached to the table top components, such the head and leg components, to be coupled to the seat and back component.

While the receiver and hook assemblies 114, 116 have been described as being attached to the frames of their respective table top components 106, 108, in some implementations, the receiver assembly is intergrally formed (e.g., die cast or injection molded) with the frame of its respective table top component. Similarly, the hook assembly can be intergrally formed (e.g., die cast or injection molded) with the frame of its respective table top component.

While the receiver assembly 114 has been described as being formed of multiple discrete walls 168, 170, 172 that are secured together, in certain implementations, the receiver assembly is a unitary device. In such embodiments, for example, the receiver assembly can be die cast or injection molded.

While the opening 166 of the transverse wall 172 of the receiver assembly 114 has been illustrated as being generally rectangular, the opening 166 can have any of various other shapes. Similarly, while the openings 166 of the transverse walls 172 in the receiver assemblies 114 associated with different table top components (e.g., table top components capable of bearing different weights) have been described as having the same general shape but different sizes, in certain embodiments, the shape of the openings 166 in the transverse walls 172 can differ from one receiver assembly 114 to another to ensure that only intended types of hook assemblies 116 can be coupled to the receiver assemblies 114. As an example, the transverse walls of receiver assemblies attached to table top components capable of bearing heavy loads can have cross-shaped openings that generally match the cross-shaped openings, while the transverse walls of receiver assemblies attached to table top components capable of bearing heavy loads can have rectangular openings. Similarly, the hook assemblies attached to table top components that are heavy or that are intended to bear heavy loads during use can have cross-shaped bosses that match the cross-shaped openings, while the hook assemblies attached to table top components that are light or that are intended to bear only light loads during use can have rectangular bosses that match the cross-shaped openings. The cross-shaped bosses of the hook assemblies attached to heavy table top components could be disposed within the cross-shaped openings of the receiver assemblies capable of bearing heavy loads but could not be disposed within the rectangular openings of the receiver assemblies capable of bearing only light loads. In contrast, the rectangular bosses of the hook assemblies attached to light table top components could be disposed within the rectangular openings of the receiver assemblies capable of bearing only light loads and within the cross-shaped openings of the receiver assemblies capable of bearing heavy loads. Other combinations of different shapes that provide this type of coding function can also be used.

While the various components of the hook assembly and the receiver assembly have been described as being formed of nickel plated aluminum alloy, other materials can be used in some cases. Examples of other suitable materials include titanium and certain beryllium aluminum alloys.

While the operating table 100 has been described as including the seat and back component 106, the head component 108, and the leg component 110, various other types of table top components can alternatively or additionally be coupled together to form table tops having different configurations. Examples of other types of table top components that can be equipped with the coupling devices described herein include cantilevered support members, pelvic extensions (e.g., radiolucent pelvic extensions), fracture setting members, boom mounts, therapy delivery mounts, transfer tables, etc. These table top components and various other table top components, like the table top components discussed above, can be equipped with receiver assemblies and hook assemblies. Each receiver assembly can have an opening in its transverse wall that is sized according to a load bearing capacity of the table top component to which it is attached, and each hook assembly can include a boss sized according to the load expected to be applied by the table top component to which it is attached to a coupled table top component during use. Sizing the openings of the receiver assemblies and the bosses of the hook assemblies in this way can provide a coding system that helps to ensure that each of the various table top components can only be coupled to another table top component if that other table top component is capable of bearing the weight of the table top component being coupled to it.

Many of the table top components described herein can be equipped with hook assemblies at one end that engage receiver assemblies of another table top component and receiver assemblies at the opposite end that receive hook assemblies of yet another table top component. In this way, it is possible, for example, to secure one table top component directly to the seat and back component 106 and to secure another table top component on the back of the table top component that is secured to the seat and back component 106. This can allow the surgical staff member to extend the length of the operating table. In many cases, the table top component that is secured directly to the seat and back component 106 will include receiver assemblies that are coded differently (e.g., include differently sized or shaped openings 166) than the receiver assemblies of the seat and back component 106, and the table top component that is secured to the back end of the table top component that is directly secured to the seat and back component 106 will include receiver assemblies that are coded differently than the receivers of both the seat and back component 106 and the table top component that is directly secured to the seat and back component 106 or will include no receiver assemblies at all.

Other embodiments are within the scope of the following claims.

What is claimed is:

1. An operating table top assembly comprising:

a first table top component;

a receiver assembly attached to or integrally formed with the first table top component, the receiver assembly comprising first and second spaced walls that define a central recess therebetween, the first wall having an outer side surface and a projection that extends laterally from the outer side surface, the projection defining an undercut;

a second table top component; and a hook assembly attached to or integrally formed with the second table top component, the hook assembly comprising an elongate hook member attached to or integrally formed with a housing, the hook member having a tip portion, the housing being configured to be at least partially disposed within the central recess of the receiver assembly, and the tip portion of the hook member being configured to matingly engage the undercut defined by the projection of the receiver assembly, wherein the housing of the hook assembly is at least partially disposed within the central recess of the receiver assembly when the first table top component is coupled to the second table top component, and the tip portion of the hook member of the hook assembly matingly engages the undercut defined by the projection of the receiver assembly when the first table top component is coupled to the second table top component, and wherein the hook assembly further comprises a spring-loaded member that can be moved between an extended position in which the spring-loaded member extends from a side surface of the housing and a retracted position in which the spring-loaded member is retracted into the housing, and one of the first and second walls of the receiver assembly defines an aperture configured to receive a portion of the spring-loaded member when the spring-loaded member is in the extended position.

2. The operating table top assembly of claim 1, wherein the first wall is positioned outwardly of the second wall relative to the first table top component, and the hook assembly is configured such that the hook member extends along the outer side surface of the first wall of the receiver assembly when the first table top component is coupled to the second table top component.

3. The operating table top assembly of claim 2, wherein the hook member of the hook assembly and the lateral projection of the receiver assembly are visible along a side surface of the operating table top such that a user can visually determine whether the tip portion of the hook member is matingly engaged with the undercut defined by the projection of the receiver assembly.

4. The operating table top assembly of claim 1, wherein the tip portion of the hook member is located at a first end region of the hook member, and the hook member comprises a lobe extending from a central region of the hook member, the projection of the receiver assembly further defining a depression configured to receive the lobe when the first table top component is coupled to the second table top component.

5. The operating table top assembly of claim 1, wherein a gap is formed between a portion of the housing and the hook member of the hook assembly, the gap being configured to receive a portion of the second wall of the receiver assembly when the first table top component is coupled to the second table top component.

6. The operating table top assembly of claim 5, wherein the hook member is attached to or integrally formed with a side wall extension of the housing, and the gap is adjacent the side wall extension.

7. The operating table top assembly of claim 1, wherein the second wall of the receiver assembly defines the aperture.

8. The operating table top assembly of claim 7, wherein the second wall is positioned inwardly of the first wall relative to the first table top component.

9. The operating table top assembly of claim 1, wherein the hook assembly further comprises an actuator assembly having an actuator that is operably connected to the spring loaded member in a manner such that movement of the actuator can move the spring-loaded member from the extended position to the retracted position.

10. The operating table top assembly of claim 9, wherein the hook assembly further comprises a locking mechanism that retains the spring-loaded member in the retracted position while the housing of the hook assembly is at least partially disposed within the central recess of the receiver assembly.

11. The operating table top assembly of claim 10, wherein the locking mechanism comprises a ball spring that engages a surface of the spring-loaded member while the housing of the hook assembly is at least partially disposed within the central recess of the receiver assembly and the spring-loaded member is retracted.

12. The operating table top assembly of claim 11, wherein the ball spring protrudes from a bottom surface of the housing and contacts an upper surface of a third wall extending between the first and second walls of the receiver assembly while the housing of the hook assembly is at least partially disposed within the central recess of the receiver assembly.

13. The operating table top assembly of claim 12, wherein the one of the first and second walls of the receiver assembly that defines the aperture configured to receive the portion of the spring-loaded member has a ramp portion arranged to depress the spring-loaded member as the housing of the hook assembly is slid into the central recess of the receiver assembly.

14. The operating table top assembly of claim 1, wherein the receiver assembly further comprises a third wall that extends between the first and second walls and that defines an opening configured to receive a boss extending from the housing, and the opening is configured to receive only bosses of hook assemblies attached to or integrally formed with second table top components that are intended for use with the first table top component to which the receiver assembly is attached or with which the receiver assembly is integrally formed.

15. An operating table top coupling device comprising:

a receiver assembly comprising first and second spaced walls that define a central recess therebetween, the first wall having an outer side surface and a projection that extends laterally from the outer side surface, the projection defining an undercut; and a hook assembly comprising an elongate hook member attached to or integrally formed with a housing, the hook member having a tip portion, the housing being configured to be at least partially disposed within the central recess of the receiver assembly, and the tip portion of the hook member being configured to matingly engage the undercut defined by the projection of the receiver assembly, wherein the hook assembly further comprises a spring-loaded member that can be moved between an extended position in which the spring-loaded member extends from a side surface of the housing and a retracted position in which the spring-loaded member is retracted into the housing, and one of the first and second walls of the receiver assembly defines an aperture configured to receive a portion of the spring-loaded member when the spring-loaded member is in the extended position.

16. An operating table top coupling device comprising:

a receiver assembly comprising first and second spaced walls that define a central recess therebetween, the first wall having an outer side surface and a projection that extends laterally from the outer side surface, the projection defining an undercut, wherein the central recess is configured to receive at least a portion of a housing of a hook assembly when the hook assembly is coupled to the receiver assembly, and the undercut is configured to matingly engage a tip portion of a hook member of the hook assembly when the hook assembly is coupled to the receiver assembly, and wherein one of the first and second walls of the receiver assembly defines an aperture configured to receive a portion of a spring-loaded member of the hook assembly when the spring-loaded member is moved into an extended position in which the spring-loaded member extends from a side surface of the housing, from a retracted position in which the spring-loaded member is retracted into the housing.

17. An operating table top coupling device comprising:

a hook assembly comprising an elongate hook member attached to or integrally formed with a housing, the hook member having a tip portion, wherein the housing is configured to be at least partially disposed within a central recess of a receiver assembly when the hook assembly is coupled to the receiver assembly, and the tip portion of the hook member is configured to matingly engage an undercut defined by a projection of the receiver assembly when the hook assembly is coupled to the receiver assembly, wherein the hook assembly further comprises a spring-loaded member that can be moved between an extended position in which the spring-loaded member extends from a side surface of the housing and a retracted position in which the spring-loaded member is retracted into the housing, and a portion of the spring-loaded member is configured to be received in an aperture defined by one of first and second spaced walls of the receiver assembly when the spring-loaded member is in the extended position.

* * * * *